US005410335A

United States Patent [19]

Sawano et al.

[11] Patent Number: 5,410,335

[45] Date of Patent: Apr. 25, 1995

[54] METHOD AND APPARATUS FOR RECORDING AN IMAGE ON A MULTICOLOR THERMAL RECORDING MATERIAL

[75] Inventors: Mitsuru Sawano; Mitsuyuki Tsurumi; Yutaka Fujita; Yuichi Itabashi, all of Shizuoka, Japan

[73] Assignee: Fuji Photo Film Co., Ltd., Kanagawa, Japan

[21] Appl. No.: 907,295

[22] Filed: Jul. 1, 1992

[30] Foreign Application Priority Data

Jul. 2, 1991 [JP] Japan ..... 3-161710
Jul. 16, 1991 [JP] Japan ..... 3-175563
Jul. 23, 1991 [JP] Japan ..... 3-182288

[51] Int. Cl.[6] ..... B41J 2/32; B41J 2/44; B41J 2/475; B41M 5/30

[52] U.S. Cl. ..... 347/172; 430/348; 430/146; 430/148

[58] Field of Search ..... 346/76 R, 76 PH, 76 L, 346/1.1, 135.1; 430/146, 148, 348

[56] References Cited

U.S. PATENT DOCUMENTS 4,734,704 3/1988 Mizutani et al. ..... 346/76 PH
4,833,488 5/1989 Mizutani et al. ..... 346/76 PH

FOREIGN PATENT DOCUMENTS 69 1/1974 Japan .
89915 7/1977 Japan .
123838 6/1986 Japan .
224930 9/1989 Japan .
19710 1/1990 Japan .
288688 12/1991 Japan .
28585 1/1992 Japan .

*Primary Examiner*—Huan H. Tran
*Attorney, Agent, or Firm*—Sughrue, Mion, Zinn, Macpeak & Seas

[57] ABSTRACT

A method for recording an image on a thermal recording material in which a plurality of color-development layers are laminated, the plurality of color-development layers being adapted to develop different colors, respectively, upon supply of thermal energy thereto and to form a substantially black color when all of the plurality of color-development layers undergo color development with a substantially identical density. With respect to a portion where a color other than black is to be developed, recording is effected such that a color-development density of each of the plurality of color-development layers becomes lower than a maximum color-development density of each of the plurality of color-development layers. Meanwhile, with respect to a portion where black is to be developed, recording is effected such that the color-development density of each of the plurality of color-development layers becomes higher than a maximum value of color-development density of a portion surrounding the portion where black is to be developed. Accordingly, the density of black becomes higher than the densities of colors other than black, so that a sharp contrast is produced in the black color of the image recorded on the recording material.

30 Claims, 25 Drawing Sheets

METHOD AND APPARATUS FOR RECORDING AN IMAGE ON A MULTICOLOR THERMAL RECORDING MATERIAL

BACKGROUND OF THE INVENTION

1. Field of the Invention

The present invention relates to a method and an apparatus for recording an image, and more particularly to a method and an apparatus for recording an image on a multicolor thermal recording material.

2. Description of the Related Art

At present, a thermal recording method is known as a method of recording an image on recording paper by using heating elements. In this thermal recording method, recording is effected by a process in which, by using a thermal recording material in which a base such as paper or synthetic paper is coated with a coupler and a developer, the thermal recording material is subjected to heat processing by means of a thermal head. For instance, a technique has been proposed wherein a thermal recording material, in which a plurality of electron-donating dye precursors and electron-receiving compounds are present in mixed form, is prepared, and heat of different temperatures is applied to the recording material by making use of the fact that color-development starting temperatures differ for the respective electron-donating dye precursors, so as to obtain an image having different hues (Japanese Patent Application Publication No. 69/1974). Such a thermal recording method has advantages in that (1) development is not required, (2) in a case where the base is paper, the paper quality is close to that of plain paper, (3) handling is easy, (4) the color-development density is high, (5) the recording apparatus is simple and inexpensive, and (6) the noise occurring during recording is smaller than in the case of a dot printer or the like. Hence, this thermal recording method has disseminated rapidly in recent years in the fields of black-and-white facsimile machines and printers.

In these fields of recording, in conjunction with rapid development made in the information industry, there has been a demand for obtaining color hard copies simply from terminals of information equipment including computers and facsimile machines.

A digital color printer is known as a printer which meets this demand. In this digital color printer, a color image is separated into the image data of yellow (Y), magenta (M), cyan (C), and black (K) with respect to the color components, and the image is recorded in each corresponding thermosensitive layer on the basis of the image data of each color.

In addition, in a case where characters are recorded on an image, character data is sometimes inputted separately so as to effect recording in such a manner as to facilitate the discrimination between the image and the characters.

The preparation of the above-described thermosensitive material having thermosensitive layers corresponding to the respective colors is complicated in production, and the production costs are high. Hence, there has been a demand for a method of recording an image on a thermosensitive material of three colors, Y, M and C.

However, in a case where a black image and characters are recorded on the multicolor thermal recording paper by the combination of the three colors of Y, M and C, as described above, densities of the color components of the black color are close to those of a color image and, hence, lacked a sharp contrast. For this reason, if the characters and the color image are recorded on the same image plane, the separation between the characters and the image is poor, which presents the problem that the discrimination of the characters is difficult.

In addition, thermal recording materials are known on which an image is recorded as light beams of different wavelength regions are applied thereto. Such thermal recording materials which have been proposed for use as photosensitive materials include, among others, the following: one in which two components of a two-component-type thermosensitive color-development medium are disposed by being separated from each other via microcapsules containing a photo-curing composition (Japanese Patent Application Laid-Open No. 89915/1977); one in which a layer containing a photopolymerizing composition and a vinyl monomer having an acidic group, an isolating layer, and a layer consisting of an electron-donating colorless dye are laminated (Japanese Patent Application Laid-Open No. 123838/1986); and one provided with a plurality of photosensitive layers which produce different colors, each photosensitive layer having a central wavelength (Japanese Patent Application Laid-Open Nos. 224930/1989 and 19710/1990). According to these techniques, as light beams of different ultraviolet wavelength regions corresponding to an image to be recorded are applied to the thermal recording material, the development of hues corresponding to the areas irradiated with the light beams and the wavelength regions of the light beams is suppressed. Then, as the thermal recording material is subjected to heating, the thermal recording material undergoes heat development in areas where the light beams were not applied, thereby forming an image.

Even if these photosensitive-type thermal recording materials are used, a problem similar to that described above is encountered.

In addition, the present inventors have proposed multicolor thermal recording materials which are provided with substantially transparent color-development layers adapted to develop different hues of color, and which make it possible to obtain an unprecedentedly excellent heatsensitized, color-developed image (Japanese Patent Application Laid-Open Nos. 288688/1991 and 28585/1992). With respect to each of these thermal recording materials, a thermal head arrayed in the main-scanning direction is moved in the sub-scanning direction to effect scanning, thereby to record an image.

According to these techniques, it is possible to obtain multicolor images with excellent hues, color separability, and image preservability, which have hitherto been impossible to obtain with the thermal recording system. In addition, it is possible to render the obtained image into a transmitted image or a reflected image.

With such thermal recording paper, in a case where a multiplicity of color-development layers are provided in a superposed state on one surface thereof, it is necessary to cause the heating and color development of an uppermost layer (a layer closest to the surface) with a quantity of heat which does not heat the other layers. Then, after completion of the fixation processing of this color-development layer, it is necessary to perform heat processing of the remaining color-development layers.

As shown in FIG. 18, the duration of this fixation processing (nth time) includes both a duration for effecting the fixing of unnecessary color-development components for suppressing the color development of each color-development layer, and a duration for effecting uncoloration so as to prevent a change with time and the coloring of the texture. Conventionally, it was necessary to wait for the heat processing ((n+1)th time) of an ensuing color-development layer until the aforementioned two processes are completed.

With such an image recording method, however, there are limits to the reduction of a total recording period. If an attempt is made to effect recording by exceeding a limit, the duration for effecting uncoloration becomes insufficient due to a shortage of the amount of light. With the lapse of time, this can possibly cause coloration of a white frame portion surrounding the image, in particular.

For this reason, it is conceivable to increase a unit amount of light of a light source, but since the quantity of heat generated in the light source increases, this measure is not suitable for thermal recording materials.

Furthermore, picture elements which are not to be made to undergo color development are sometimes present in an image. For instance, there is no need to cause color development in the frame portion surrounding the image.

No heat is applied to those picture elements whose indicated density based on an image signal is 0, and a difference occurs in the luster as between a portion to which heat has been applied and a portion to which it has not. The difference in luster results in an unnatural image, so that there is the problem that it is impossible to reproduce a proper image based on the image signal.

To overcome this problem, it is conceivable to provide an arrangement in which, by providing a heat roller downstream in a traveling direction of the thermal recording paper, the overall surface of the thermal recording paper is subjected to heat processing with a predetermined amount of energy by this heat roller after completion of the heat processing of all the color-development layers.

Consequently, it is possible to make the luster uniform, improve the reproducibility of the image, and overcome the unnaturalness of the image.

With such an image recording method, however, since the duration for heating the overall surface by the heat roller is added to the duration for the heat processing of the respective color-development layers, the overall recording period becomes disadvantageously prolonged.

SUMMARY OF THE INVENTION

In view of the above-described circumstances, it is an object of the present invention to provide an image recording method which is capable of recording with a sharp contrast of a black color when an image is recorded.

In addition to the above-described object, it is another object of the present invention to provide an image recording apparatus which is capable of recording with a sharp contrast of a black color and characters.

Still another object of the present invention is to provide an image recording method which is capable of reducing a recording period on the basis of the characteristics of time durations required for the fixing of unnecessary color-development components and for uncoloration which are effected during fixation processing.

A further object of the present invention is to provide an image recording method which is capable of rendering the luster of a finished image uniform and improving the reproducibility based on an image signal without prolonging the overall recording period.

In accordance with a first aspect of the present invention, in recording an image on a thermal recording material in which a plurality of color-development layers are laminated, the plurality of color-development layers being adapted to develop different colors, respectively, upon supply of thermal energy thereto and to form a substantially black color when all of the plurality of color-development layers undergo color development with a substantially identical density, recording is effected as follows: With respect to a portion where a color other than black is to be developed, a color-development density of each of the plurality of color-development layers becomes lower than a maximum color-development density of each of the plurality of color-development layers. Meanwhile, with respect to a portion where black is to be developed, the color-development density of each of the plurality of color-development layers becomes higher than a maximum value of color-development density of a portion surrounding the portion where black is to be developed.

In accordance with the above-described first aspect of the invention, the thermal recording material has a plurality of laminated color-development layers adapted to develop different colors upon supply of thermal energy thereto. These color-development layers form a substantially black color when all of them undergo color development with a substantially identical density. For instance, as a thermal recording material on which an image is formed in correspondence with a quantity of heat supplied thereto, a thermal recording material is known which develops mutually different colors in correspondence with amounts of heat supplied thereto. In addition, as a thermal recording material on which an image is formed in correspondence with the wavelength of each light beam applied thereto, a thermal recording material is known which has a medium that develops mutually different colors or suppresses color development by application of light beams of different wavelengths thereto. With respect to these thermal recording materials, when a color other than black is to be developed, recording is effected such that a color-development density of each of the color-development layers becomes lower than a maximum color-development density of each of the color-development layers. With respect to a portion where black is to be developed, recording is effected such that the color-development density becomes higher than a maximum value of color-development density of a portion surrounding that portion. Accordingly, the density of the black portion recorded on the thermal recording material-becomes higher than that of each color of the image. Hence, the black color is recorded with a desirable density which facilitates the discrimination thereof.

In accordance with a second aspect of the invention, in recording an image on a thermal recording material in which a plurality of color-development layers are laminated, the plurality of color-development layers being adapted to develop different colors, respectively, upon supply of thermal energy thereto and to form a substantially black color when all of the plurality of color-development layers undergo color development with a substantially identical density, recording is effected as follows: With respect to a portion where an image other than a character is to be recorded, the image other than the character is recorded such that a color-development density of each of the plurality of color-development layers becomes lower than a maximum color-development density of each of the plurality of color-development layers. Meanwhile, with respect to a portion where a character image is to be recorded by causing at least one of the plurality of color-development layers to undergo color development, the character image is recorded such that the color-development density of each of the plurality of color-development layers becomes higher than a maximum value of color-development density of a portion surrounding that portion.

In the image recording method in accordance with the above-described second aspect, a character image is recorded on the thermal recording material. In a case where a character image is recorded by causing at least one of the plurality of color-development layers to undergo color development, the color-development density of each color-development layer where the character image is to be recorded is set to be higher than a maximum value of color-development density of a portion surrounding the portion where the character image is to be recorded. For this reason, the density of the character image in the image becomes higher than the density of the surrounding portion. Accordingly, a character image which has a desirable density and is not buried in an image other than the character is recorded.

In accordance with a third aspect of the invention, there is provided an image recording apparatus comprising: a heat source for supplying thermal energy to a thermal recording layer in which a plurality of color-development layers adapted to develop different colors in correspondence with an amount of energy supplied thereto are laminated; and control means for controlling the heat source such that, with respect to a portion where a color other than black is to be developed, a color-development density of each of the plurality of color-development layers becomes lower than a maximum color-development density of each of the plurality of color-development layers, and for controlling the heat source such that, with respect to a portion where black is to be developed, the color-development density of each of the plurality of color-development layers becomes higher than a maximum value of color-development density of a portion surrounding the portion where black is to be developed.

In addition, in accordance with a fourth aspect of the invention, there is provided an image recording apparatus comprising: a heat source for supplying thermal energy to a thermal recording layer in which a plurality of color-development layers adapted to develop different colors in correspondence with an amount of energy supplied thereto are laminated; and control means for controlling the heat source such that, with respect to a portion where an image other than a character is to be recorded, a color-development density of each of the plurality of color-development layers becomes lower than a maximum color-development density of each of the plurality of color-development layers, and for controlling the heat source such that, with respect to a portion where a character image is to be recorded by causing at least one of the plurality of color-development layers to undergo color development, the color-development density of each of the plurality of color-development layers becomes higher than a maximum value of color-development density of a portion surrounding the portion where the character image is to be recorded.

In the image recording apparatuses in accordance with the above-described third and fourth aspects, an image is recorded on a thermal recording material. This thermal recording material has a plurality of thermosensitive color-development layers which are adapted to develop different colors. The heat source supplies a quantity of heat corresponding to image data inputted from the control means. The control means controls the heat source in such a manner that a maximum density of each color of the image becomes lower than a maximum color-development density of each color-development layer. Here, in the image recording apparatus in accordance with the third aspect, when an image is recorded in black by causing all the color-development layers to undergo color development, the control means controls the heat source in such a manner that the density of each color-development layer becomes higher than the maximum density of each color of the image. In addition, in the image recording apparatus in accordance with the fourth aspect, when a character image is recorded by causing at least one color-development layer to undergo color development, the control means controls the heat source in such a manner that the density of each color-development layer becomes higher than the maximum density of each color of the image. Consequently, when the black color is recorded, the density of the portion of the black color recorded on the thermal recording material becomes higher than the density of each color of the image. Hence, the black color is recorded with a desirable density which facilitates discrimination thereof. Meanwhile, when a character image is recorded, the density of the character image in the image recorded on the thermal recording material becomes higher than the density of the surrounding portion. For this reason, a sharp contrast is produced in the black color and the character in the image. Therefore, by using this image recording apparatus, the above-described image recording method can be realized easily. In addition, since the black color is recorded with the three colors of yellow, magenta, and cyan, the process of black-color development processing can be omitted, so that the apparatus can be simplified.

Furthermore, in accordance with a fifth aspect of the invention, there is provided an image recording apparatus comprising: irradiating means for applying light to a thermal recording layer having a plurality of layers whose color development is suppressed as the light of different ultraviolet wavelength regions is applied to the plurality of layers, so as to expose the thermal recording material; control means for controlling an exposure by the irradiating means such that, with respect to a portion where a color other than black is to be developed, a color-development density of each of the plurality of color-development layers becomes lower than a maximum color-development density of each of the plurality of color-development layers, and for controlling the exposure by the irradiating means such that, with respect to a portion where black is to be developed, the color-development density of each of the plurality of color-development layers becomes higher than a maximum value of color-development density of a portion surrounding the portion where black is to be developed; and a heat source for heating the thermal recording material exposed, so as to effect heat development of the thermal recording material.

In accordance with a sixth aspect of the invention, there is provided an image recording apparatus comprising: irradiating means for applying light to a thermal recording layer having a plurality of layers whose color development is suppressed as the light of different ultraviolet wavelength regions is applied to the plurality of layers, so as to expose the thermal recording material; control means for controlling an exposure by the irradiating means such that, with respect to a portion where an image other than a character is to be recorded, a color-development density of each of the plurality of color-development layers becomes lower than a maximum color-development density of each of the plurality of color-development layers, and for controlling the exposure by the irradiating means such that, with respect to a portion where a character image is to be recorded by causing at least one of the plurality of color-development layers to undergo color development, the color-development density of each of the plurality of color-development layers becomes higher than a maximum value of color-development density of a portion surrounding the portion where the character image is to be recorded; and a heat source for heating the thermal recording material exposed, so as to effect heat development of the thermal recording material.

In accordance with a seventh aspect of the invention, there is provided a method of recording an image onto a thermal recording material in which a plurality of thermosensitive color-development layers are laminated, the plurality of thermosensitive color-development layers having mutually different sensitivities and being adapted to develop mutually different hues of color, comprising the steps of: (a) causing a recording head to effect the scan recording of each of the plurality of thermosensitive color-development layers; (b) fixing each of the plurality of thermosensitive color-development layers scan recorded by application of light thereto; and (c) repeating steps (a) and (b) to record an image onto the thermal recording material, wherein the application to the thermal recording material of light capable of fixing a color to be developed by an nth scan recording (n is an integer) is continued after the starting of an (n+1)th scan recording.

In accordance with the invention of this aspect, when fixation is effected after causing color development by an nth scan recording, light for fixing this color-development layer is applied thereto. Through the application of this light, the fixation of unnecessary color-development components in the color-development layer corresponding to an nth cycle of scan recording is first effected. At the same time as this fixation processing, uncoloration processing is effected to prevent the coloration of the texture (particularly white portions surrounding an image) which occurs due to a change with time or the like (see FIG. 18). There is a difference between the time duration required for the fixation of the unnecessary color-development components and the time duration required for the uncoloration, and the fixation of the unnecessary color-development components is first completed. When the fixation of the unnecessary color-development components is completed, the color development of the color-development layer corresponding to the nth cycle of scan recording is suppressed. Hence, it becomes possible for the nth fixation (during which the uncoloration is completed) to be conducted after the starting of an (n+1)th scan recording, so that it is becomes unnecessary to wait for the completion of the nth fixation.

That is, the period which has hitherto been considered as one unit of fixation processing is divided into the period for the fixation of unnecessary color-development components and the period for uncoloration. By taking the respective characteristics into account, the starting of the (n+1)th scan recording is set to take place after the completion of the fixation of the unnecessary color-development components, so that the overall recording time can be shortened.

In accordance with an eighth aspect of the invention, there is provided a method of recording an image onto a thermal recording material in which a plurality of thermosensitive color-development layers are laminated by imparting energy thereto in correspondence with a predetermined density value set on the basis of a level of an image signal, the plurality of thermosensitive color-development layers having mutually different sensitivities and being adapted to develop mutually different hues of color, comprising the steps of: (a) causing a recording head to effect the scan recording of each of the plurality of thermosensitive color-development layers; (b) fixing each of the plurality of thermosensitive color-development layers scan recorded by application of light thereto; and (c) repeating steps (a) and (b) to record an image onto the thermal recording material, wherein maximum energy of the energy imparted to the color-development layer for which the scan recording has already been completed is imparted to a portion where an indicated density at least based on the image signal is 0.

Ordinarily, when the indicated density based on the image signal is 0, no energy is applied to the pixel corresponding that image signal.

For this reason, a difference occurs in luster between the pixel to which energy is applied and the pixel to which it is not.

In accordance with the above-described eighth aspect, maximum energy of the energy imparted to the color-development layer for which scan recording has already been completed is imparted to the pixel where the indicated density based on the image signal is 0. For instance, in the case of the apparatus in which scan recording is effected by subjecting the thermal recording material to heat processing by a thermal head, by forming transport rollers for discharging the thermal recording material as heat rollers, the overall recording period can be shortened as compared with an apparatus in which the number of processes is increased by the addition of separate heat rollers. As a result, it is possible to obtain an image in which the luster of the finished image is made uniform and the reproducibility is improved.

In accordance with a ninth aspect of the invention, there is provided a method of recording an image onto a thermal recording material in which a plurality of thermosensitive color-development layers are laminated by imparting energy thereto in correspondence with a predetermined density value set on the basis of a level of an image signal, the plurality of thermosensitive color-development layers having mutually different sensitivities and being adapted to develop mutually different hues of color, comprising the steps of: (a) causing a recording head to effect the scan recording of each of the plurality of thermosensitive color-development layers; (b) fixing each of the plurality of thermosensitive color-development layers scan recorded by application of light thereto; and (c) repeating steps (a) and (b) to record an image onto the (n−thermal recording material, wherein maximum energy for an 1)th scan recording (n is an integer) is imparted to a portion where an indicated density based on the image signal is 0, during an nth scan recording.

In accordance with the above-described ninth aspect, maximum energy for an (n−1)th scan recording is imparted during an nth scan recording to the pixel where the indicated density based on the image signal is 0. As a result, it is possible to impart energy to the pixel where the indicated density based on the image signal is 0, during the period of scan recording energy, without affecting the color-development layer which undergoes color development by the nth and subsequent scan recordings. Hence, the overall recording period can be shortened.

The other objects, features and advantages of the present invention will become more apparent from the following detailed description of the invention when read in conjunction with the accompanying drawings.

DETAILED DESCRIPTION OF THE PREFERRED EMBODIMENTS

Referring now to the accompanying drawings, a detailed description will be given of the embodiments of the present invention.

First Embodiment

In a first embodiment, the present invention is applied to a digital color printer 10.

First, a description will be given of a thermal recording material 12 used in the first embodiment of the present invention.

Figure 3:
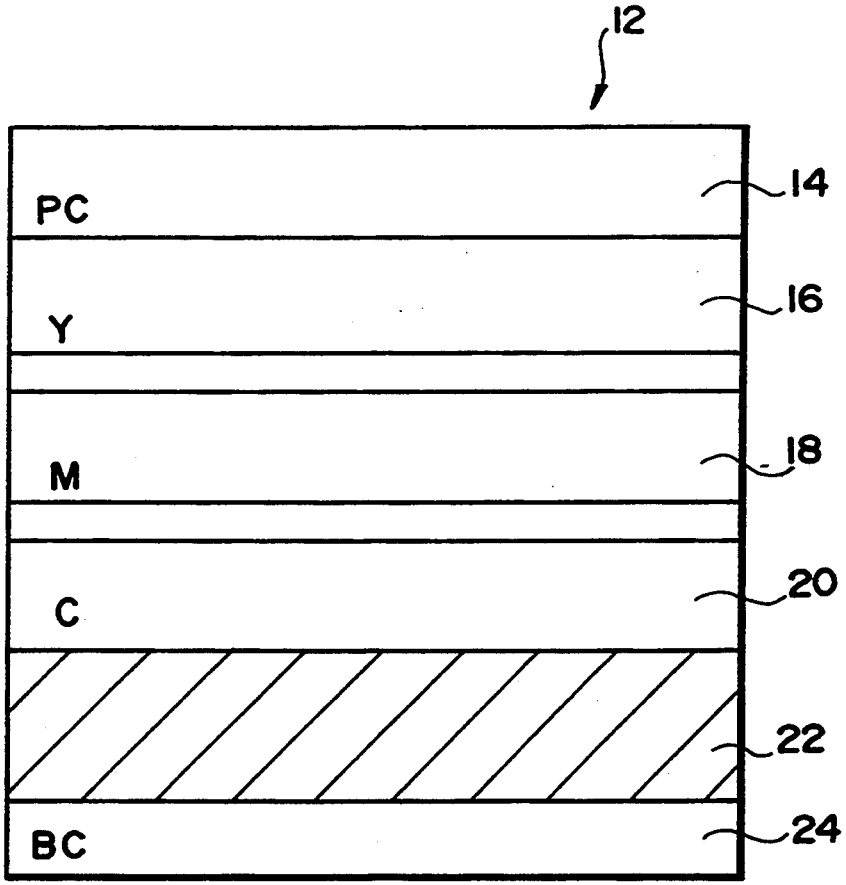
FIG. 3 is a cross-sectional view illustrating the arrangement of a thermal recording material used in the first embodiment.

As shown in FIG. 3, the thermal recording material 10 used in this embodiment is arranged such that thermosensitive color-development layers consisting of first, second and third thermal recording layers 20, 18, and 16 are laminated in that order on a surface (on one surface) of a base 22. In addition, a protective layer 14 is coated on the surface of the third thermal recording layer 16 so as to protect the color-development layers from damage. Furthermore, a back-coating layer 24 is similarly coated on a reverse surface (on the other surface) of the base 22. The principle components of the first thermal recording layer 20 are an electron-donating dye precursor and an electron-receiving compound. The second thermal recording layer 18 contains a diazonium salt compound whose maximum absorption wavelength is 360±20 nm and a coupler which produces a color upon reacting with the diazonium salt compound during heating. The third thermal recording layer 16 contains a diazonium salt compound whose maximum absorption wavelength is 400±20 nm and a coupler which produces a color upon reacting with the diazonium salt compound during heating.

In terms of the procedure of recording an image on this thermal recording material 12, heat 1 sufficient for recording in the third thermal recording layer 16 is applied to the third thermal recording layer 16, thereby causing the diazonium salt and the coupler contained in the third thermal recording layer 16 to produce a color. Then, ultraviolet light UV1 of a 400±20 nm wavelength is applied to the thermal recording material 12 so as to impart thereto heat 2 sufficient for decomposing the diazonium salt contained in the third thermal recording layer 16 and for recording in the second thermal recording layer 18, thereby causing the diazonium salt and the coupler contained in the second thermal recording layer 18 to produce a color. At that time, although strong thermal energy is applied to the third thermal recording layer 16, since the diazonoium salt is decomposed and its color development capability has been lost, the third thermal recording layer 16 no longer produces a color. Then, ultraviolet light UV2 of a 360±20 nm wavelength is applied to the thermal recording material 12 so as to impart thereto heat 3 sufficient for decomposing the diazonium salt contained in the second thermal recording layer 18 and for recording in the first thermal recording layer 20, thereby causing the electron-donating dye precursor and the electron-receiving compound contained in the first thermal recording layer 20 to produce a color. At that time, although strong thermal energy is applied to the third thermal recording layer 16 and the second thermal recording layer 18, since the diazonoium salt is decomposed and its color development capability has been lost, these thermal recording layers 16 and 18 no longer produce colors.

Here, in this embodiment, the hues of color to be developed in the first, second, and third thermal recording layers are selected in such a manner as to become the three primary colors in a subtractive mixture, i.e., cyan, magenta, and yellow. In other words, the first thermal recording layer is the C layer 20 whose hue of color to be developed is cyan, the second thermal recording layer is the M layer 18 whose hue of color to be developed is magenta, and the third thermal recording layer is the Y layer 16 whose hue of color to be developed is yellow. Accordingly, if recording is effected by the above-described procedure, a full-color image can be recorded on the thermal recording material 12.

Figure 4:
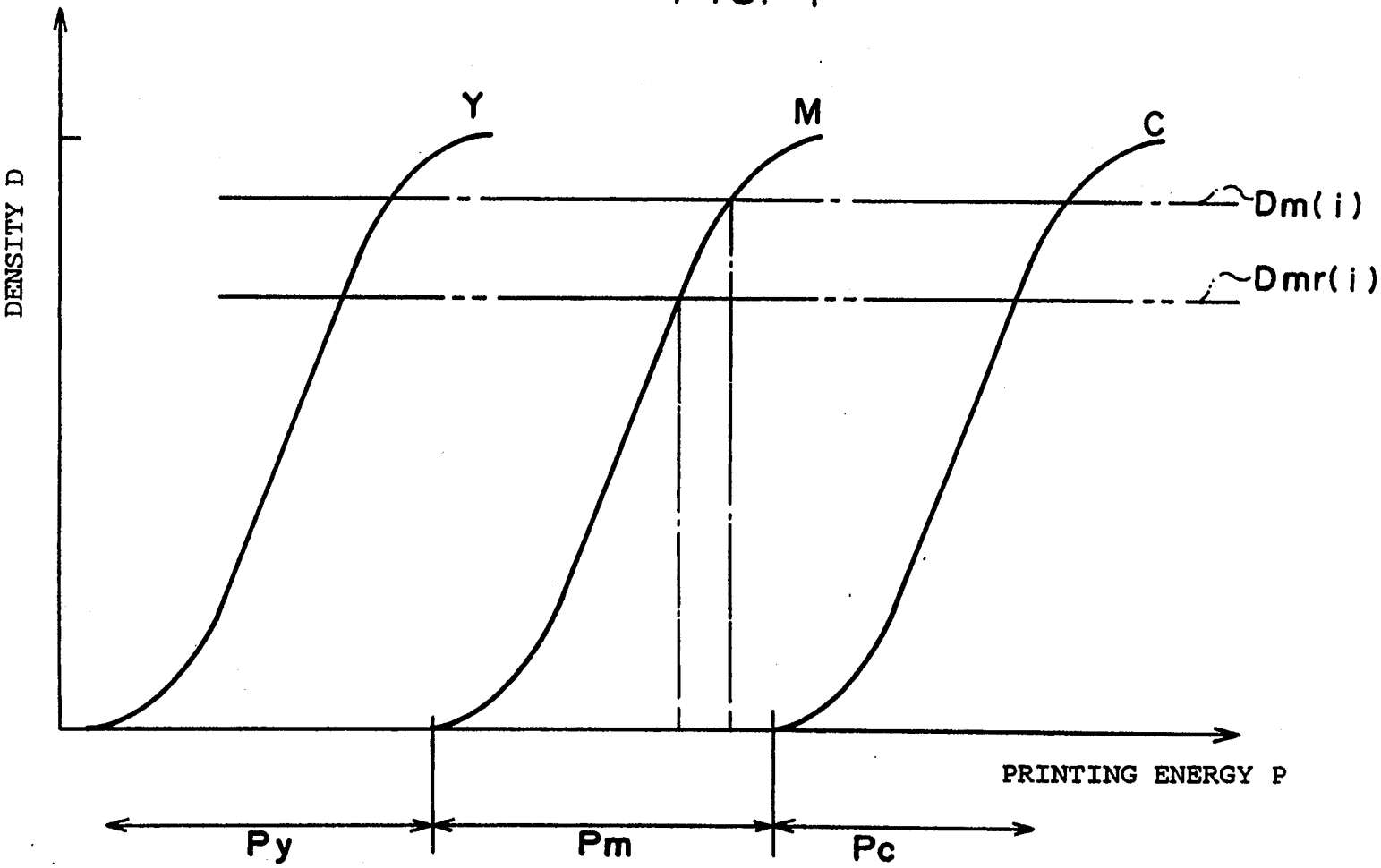
FIG. 4 is a diagram illustrating the relationship between printing energy and the color-development density in accordance with the first embodiment.

In addition, in the thermal recording material 12 used in this embodiment, the yellow layer 16, the M layer 18, and the C layer 20 are adapted to undergo color development with color-development densities corresponding to the thermal energy of different intensities, respectively, as shown in FIG. 4. That is, the Y layer 16 undergoes color development in correspondence with the thermal energy in a thermal energy area Py, the M layer 18 undergoes color development in correspondence with the thermal energy in a thermal energy area Pm, and the C layer 20 undergoes color development in correspondence with the thermal energy in a thermal energy area Pc.

Next, referring to the schematic structure shown in FIG. 2, a description will be given of the digital color printer 10 in accordance with the first embodiment of the present invention.

Figure 2:
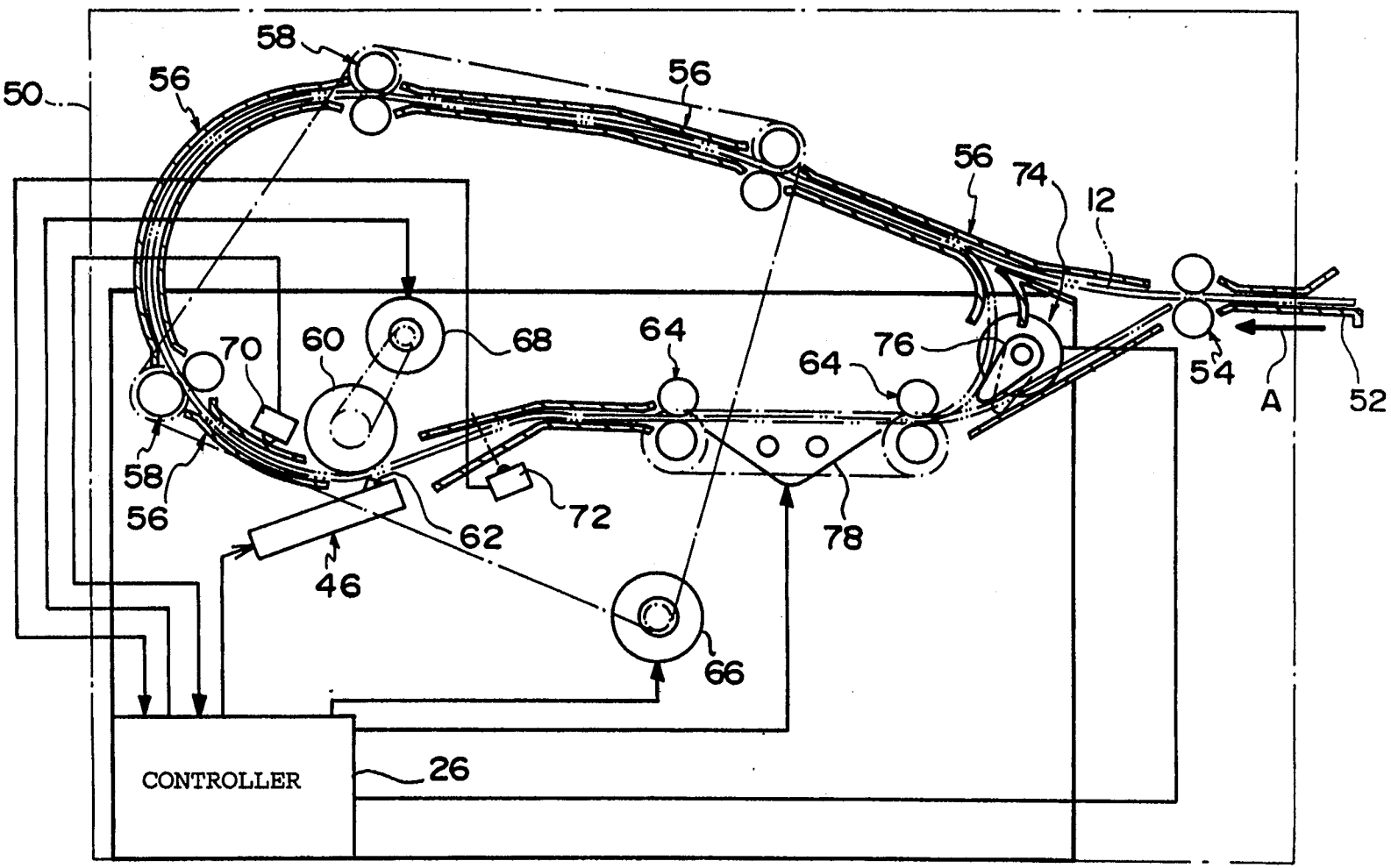
FIG. 2 is a cross-sectional view schematically illustrating a digital color printer 10 in accordance with the first embodiment.

A table 52 on which the thermal recording material 12 is placed projects from a right-hand side, as viewed in FIG. 2, of a casing 50. When the thermal recording material 12 is placed on this table 52 with the recording layers thereof facing upward, and a leading end of the thermal recording material 12 is inserted into the casing 50, the thermal recording material 12 is transported in the direction of arrow A in FIG. 2.

A pair of transport rollers 54 for transporting the thermal recording material 12 in a nipped state are disposed on the downstream side of the table in the traveling direction of the thermal recording material. A plurality of guide plates 56 for guiding the thermal recording material 12 are arranged sequentially on-the downstream side of the transport rollers 54. The thermal recording material 12 is transported substantially in the shape of the letter C by the plurality of guide plates 56.

The transport rollers 54 are coupled to a rotating shaft of an unillustrated motor. The motor is electrically connected to a controller 26, and the forward and reverse rotation of the motor is controlled by the controller 26 as the thermal recording material 12 is inserted or discharged.

A pair of transport rollers 58 are disposed between adjacent ones of the plurality of guide plates 56. These transport rollers 58 are connected to each other by means of an endless belt, and this belt is coupled to a rotating shaft of a motor 66. The motor 66 is electrically connected to the controller 26, and is adapted to rotate in only one direction (counterclockwise in FIG. 2) by means of a signal from the controller 26.

A platen roller 60 is disposed on one side of the transport passage of the thermal recording material 12 in correspondence with the surface of the thermal recording material 12 where the color-development layers have not been formed. The platen roller 60 is coupled to a rotating shaft of a motor 68 via a drive belt. The motor 68 is adapted to rotate in only one direction by means of a signal from the controller 26.

A line-type thermal head 46, which is a recording head, is disposed on the other side of the transport passage of the thermal recording material 12. Heating elements 62 are fixed on one end of the thermal head 46, and when image signals are supplied from the controller 26, the heating elements 62 generate heat in response to the image signals so as to heat the thermal recording material 12. It should be noted that the quantity of heat of the heating elements 62 can be changed depending on the heating time.

In addition, a positioning signal is also outputted to the thermal head 46 from the controller 26, and the positioning signal is outputted during the heating and recording of the initial dye layer (the Y dye layer in this embodiment) so as to record a bar-like positioning mark. It should be noted that this positioning mark is recorded after the lapse of a predetermined time from the time when the leading end of the thermal recording material 12 is detected by a first photoelectric sensor 70. The recording timings for recording the other dye layers (M layer and C layer) are determined on the basis of this positioning mark.

Two pairs of transport rollers 64 are disposed on the downstream side of the platen roller 60, and the thermal recording material 12 is nipped by the transport rollers 64. A second photoelectric sensor 72 is disposed between the platen roller 60 and the transport rollers 64. This second photoelectric sensor 72 is electrically connected to the controller 26 so as to detect the positioning mark and output a signal detected.

The two pairs of transport rollers 64 are connected to each other via a drive belt. The transport rollers 64 are coupled to a rotating shaft of an unillustrated motor, and are adapted to rotate in only one direction in response to a signal from the controller 26.

Two light sources 78 for applying light beams to the surface (color-development layers' side) of the thermal recording material 12 are disposed between the two pairs of transport rollers 64. These light sources 78 are adapted to be turned on and off in response to a signal from the controller 26.

The wavelength of the light radiated from these light sources 78 can be changed over between about 365 nm and 420 nm, and are used for fixing the Y dye layer and the M dye layer of the thermal recording material 12.

A transport-passage changeover means 74 having a cam 76 is disposed on the downstream side of the transport rollers 64. As the cam 76 rotates in response to a signal from the controller 26, the transport passage of the thermal recording material 12 is changed over between a discharging direction (in the rightward direction in FIG. 2) and the direction of a loop (in the upward direction in FIG. 2).

The thermal recording material 12 guided in the discharging direction is transported to the vicinity of the transport rollers 54. Here, as the transport rollers 54 are reversely rotated, the transport rollers 54 nip the thermal recording material 12 being transported by the guide plates and transport the same onto the table 52.

Meanwhile, the thermal recording material 12 guided in the direction of the loop passes through a hole provided in the guide plates 56, is nipped again by the transport rollers 58, and reaches a loop-like transport passage. That is, in this embodiment, since the same surface is subjected to scanning (heat processing) three times, the thermal recording material 12 inserted from the table 52 is guided into the loop-like transport passage by the cam 76, and after the third scanning the cam 76 is set in the discharging direction, so as to discharge the thermal recording material 12 onto the table 52.

Figure 1:
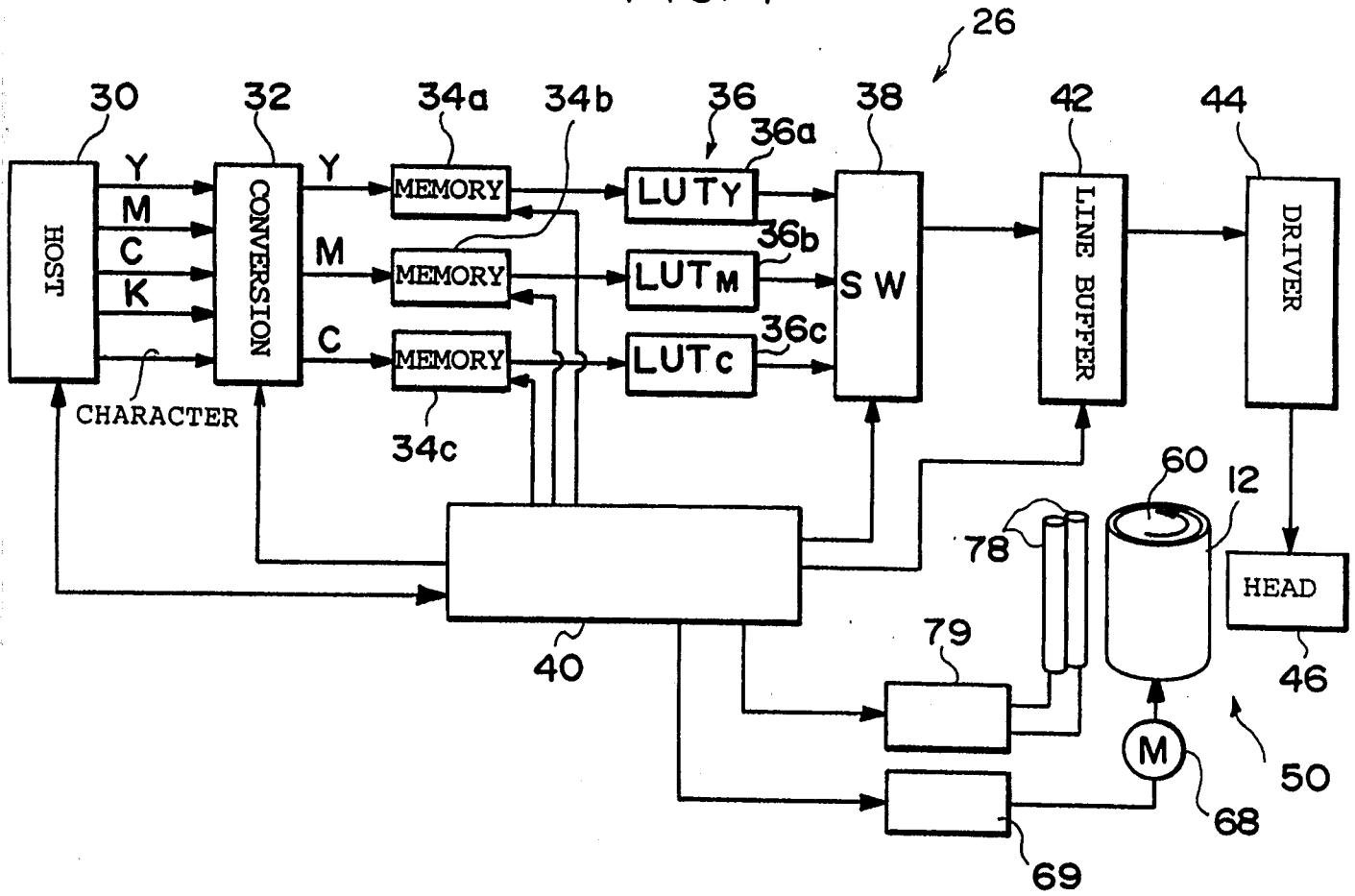
FIG. 1 is a block diagram illustrating a configuration of a controller in accordance with a first embodiment.

Referring now to FIG. 1, a description will be given of the controller 26. A host computer 30 is electrically connected to the controller 26.

Image data is stored in the host computer 30 as digital image signals. The digital image signals supplied from the host computer 30 are inputted to a conversion circuit 32. The conversion circuit 32 converts the inputted digital image signals into signals corresponding to the respective colors of Y, M and C and outputs the same to corresponding frame memories 34. A one-image portion of the image signals of a corresponding color is stored in each of the frame memories 34. In addition, the host computer 30 is electrically connected to a controller 40, and a horizontal synchronizing signal and a vertical synchronizing signal from the host computer 30 are inputted to the controller 40. The horizontal synchronizing signal and the vertical synchronizing signal are outputted to the conversion circuit 32 and the frame memories 34 to establish synchronization.

The YMC signals outputted from the frame memories 34, i.e., image density data, are converted to driving values of Y, M and C colors corresponding to color-development densities by a lookup table (hereafter, LUT) 36, and are then outputted to a line buffer 42 for each line via a switch 38. Here, the switch 38 is electrically connected to the controller 40, and signals corresponding to the color at the time of recording are supplied to the line buffer 42.

The vertical synchronizing signal from the controller 40 is inputted to the line buffer 42, and the signal is outputted to the thermal head 46 via a driver 44 on the basis of this vertical synchronizing signal, thereby heating the thermal head 46. An image is recorded onto the thermal recording material 12 by this heat.

The controller 40 is electrically connected to the motor 68 via a driver 69, and sends a signal so as to rotate the platen roller 60. In addition, the controller 40 is connected to the light sources 78 via a driver 79, and sends a control signal corresponding to the hue to be recorded onto the thermal recording material 12. As a result, the light sources 78 are changed over to selectively emit light beams of a 365 nm and a 420 nm wavelength to the thermal recording material 12.

In this manner, Y is recorded in the first scanning, M is recorded in the second scanning, and C is recorded in the third scanning.

Figure 6:
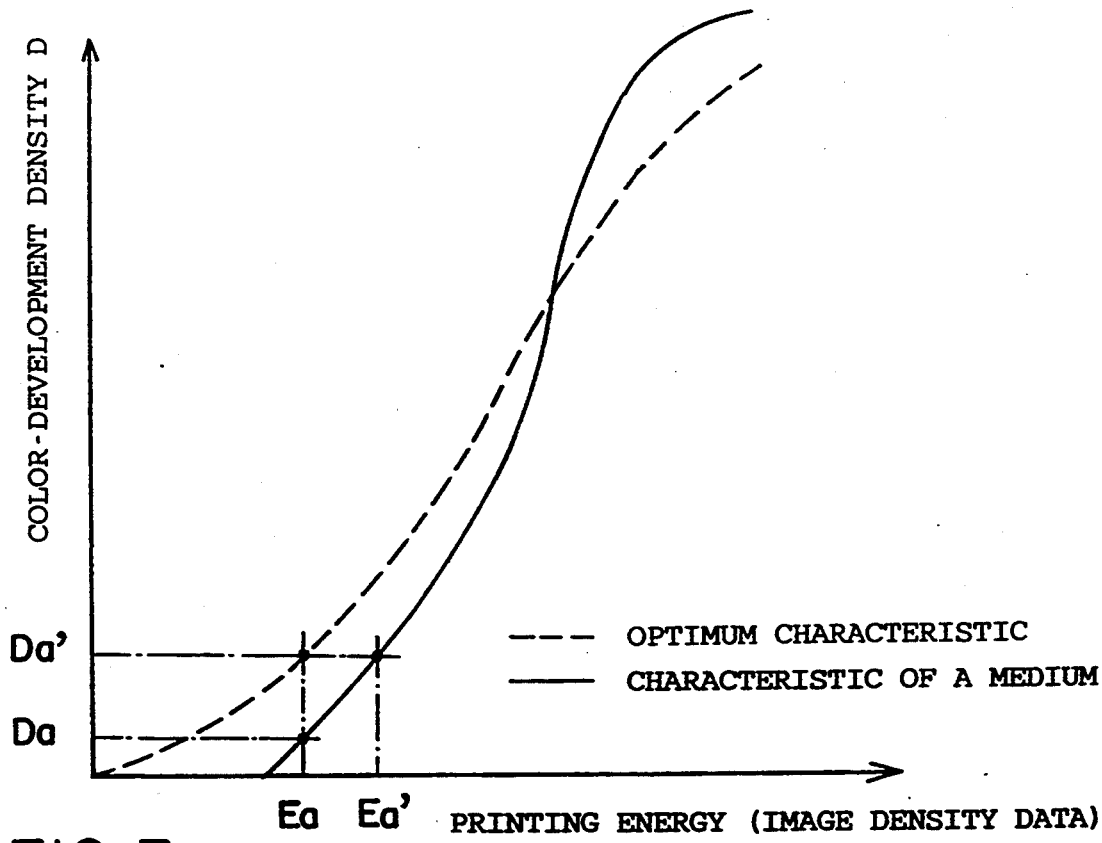
FIG. 6 is a diagram illustrating the relationship between the printing energy (image density data) and the color-development density.
Figure 7:
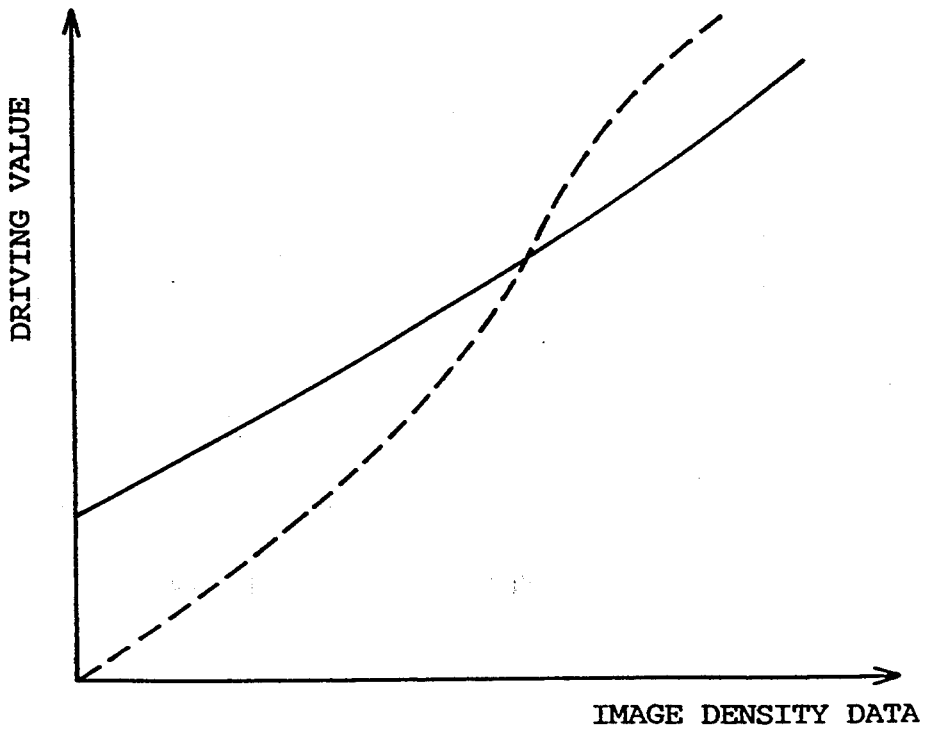
FIG. 7 is a diagram illustrating the relationship between the printing energy (image density data) and a driving value.

Referring next to FIGS. 6 and 7, a description will be given of the lookup table (LUT). In the thermal recording material 12, the characteristic of a color-development density D with respect to printing energy E corresponding to the image density data does not become optimum, as shown in FIG. 6. Consequently, even if recording is effected to obtain desired color-development densities, the color-development densities of the thermal recording material 12 become different, so that an image of desired densities cannot be obtained. Hence, a table is prepared in such a manner that the characteristic of the color-development density D with respect to the printing energy E becomes optimum. For instance, at printing energy Ea, the thermal recording material 12 exhibits a color-development density Da. Since the color-development density D which is desired at this printing energy Ea is a density Da', printing energy Ea' is required. Accordingly, a table is prepared for fetching such printing energy Ea' in which the color-development density D corresponds to the density Da' at the printing energy Ea. Namely, as shown in FIG. 7, the characteristic of driving values (quantities of heat) of the thermal head which make it possible to obtain optimum color-development densities in correspondence with the image density data is prepared, and this characteristic is set as the LUT.

Here, a description will be given of the handling of the image data of an image in this embodiment. First, in the case of the subtractive mixture, it is known that the mixing of Y, M, and C colors at a predetermined mixing ratio gives a black color. If this process is expressed by a formula, we have the following Formula (1):

$$Dm\,(K,\,i)=Dm\,(Y,\,i)+Dm\,(M,\,i)+Dm\,(C,\,i) \qquad \ldots (1)$$

where, i=1, 2, 3 (corresponding to Y, M and C)

Dm (K, i): maximum density of black (density of a color i )

Dm (Y, i): maximum density of yellow (same as above)

Dm (M, i): maximum density of magenta (same as above)

Dm( C, i ): maximum density of cyan (same as above)

In addition, the density of black can be expressed by the following Formula (2):

$$Dk\,(K,\,i)=Dk\,(Y,\,i)+Dk\,(M,\,i)+Dk\,(C,\,i) \qquad \ldots (2)$$

where, i=1, 2, 3 (corresponding to Y, M and C)

Dk (K, i): maximum density of black (density of the color i)

Dk (Y, i): maximum density of yellow when black is color-separated (same as above)

Dk (M, i): maximum density of magenta when black is color-separated (same as above)

Dk (C, i): maximum density of cyan when black is color-separated (same as above)

In this embodiment, when an image is recorded on the thermal recording material, recording is effected such that the maximum densities of the respective colors of the image become lower than the maximum color-development densities of the respective color-development layers. At that time, when the image is recorded in such a manner as to develop black by causing the plurality of color-development layers to develop colors, recording is effected such that the maximum color-development densities of the respective color-development layers become higher than the maximum densities of the respective colors. Accordingly, the relationship of the image densities can be expressed by the relation shown in the following Formula (3):

$$Dmr\ (i) < Dmk\ (i) \leqq Dm\ (i) \quad \ldots (3)$$

where, i=1, 2, 3 (corresponding to Y, M and C)
Dmr (i): maximum density of the image in each color
Dmk (i): maximum density of each color after color separation of black
Dm (i): maximum density with which each color can be developed in the material It should be noted that when character data is additionally inputted, the aforementioned relation can be rewritten as follows:

$$Dmr\ (i) < Dmc\ (i) < Dm\ (i)$$

where, i=1, 2, 3 (corresponding to Y, M and C)
Dmc (i): maximum density of each color after separation of the color of the character At this juncture, if the region of change in the image density is a linear region, the relation is shown by the following Formula (4):

$$1/\alpha i\ .\ Dmr\ (i) = i/\beta i\ .\ Dmk\ (i) = Dm\ (i) \quad \ldots (4)$$

where, i=1, 2, 3 (corresponding to Y, M and C)

$$\alpha i < \beta i,\ \beta i \leqq 1$$

Consequently, a density Dp (i) during recording can be expressed as shown in the following Formula (5):

$$Dp\ (i) = \alpha i.D\ (i) + \beta i.Dk\ (i) \quad \ldots (5)$$

where, i=1, 2, 3 (corresponding to Y, M and C)
D (i): density of each color of the image data of inputted Y, M and C
Dk (j): density of each color after color separation of inputted black Accordingly, by obtaining these coefficients $\alpha i$ and $\beta i$, black can be readily converted to the three colors of Y, M and C.

The present inventors conducted a recording experiment by effecting conversion based on data shown in Table 1 below, and it was experimentally confirmed that it is possible to obtain excellent results in which a sharply contrasted image can be recorded as black.

TABLE 1

| Hue | Dmr | Dmk | Dmc | Dm |
|---|---|---|---|---|
| Y | 1.4 | 1.6 | 1.7 | 1.8 |
| M | 1.4 | 1.6 | 1.7 | 1.9 |
| C | 1.4 | 1.6 | 1.7 | 1.7 |

Figure 8:
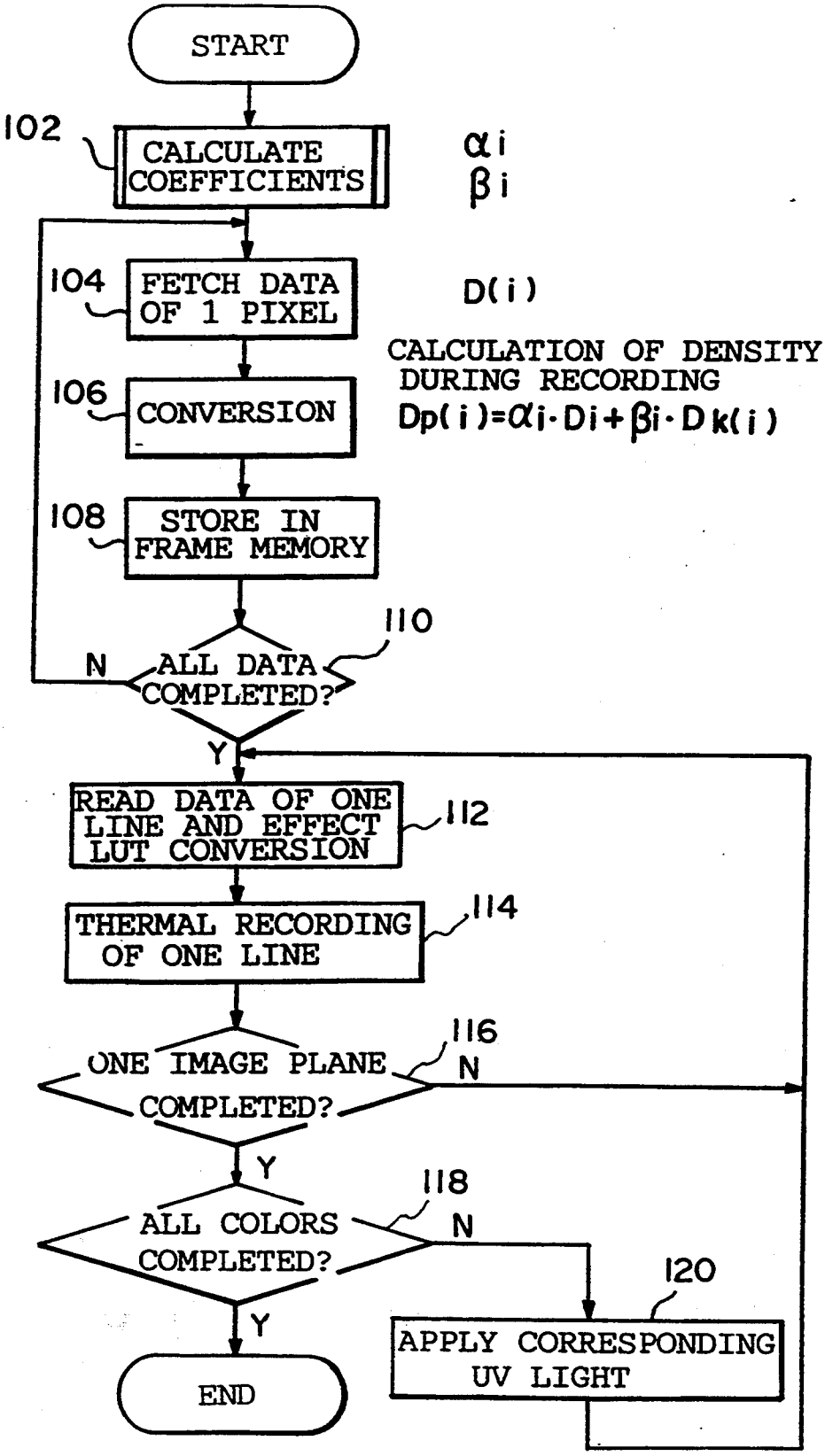
FIG. 8 is a flowchart illustrating a main routine for control in accordance with the first embodiment.
Figure 9:
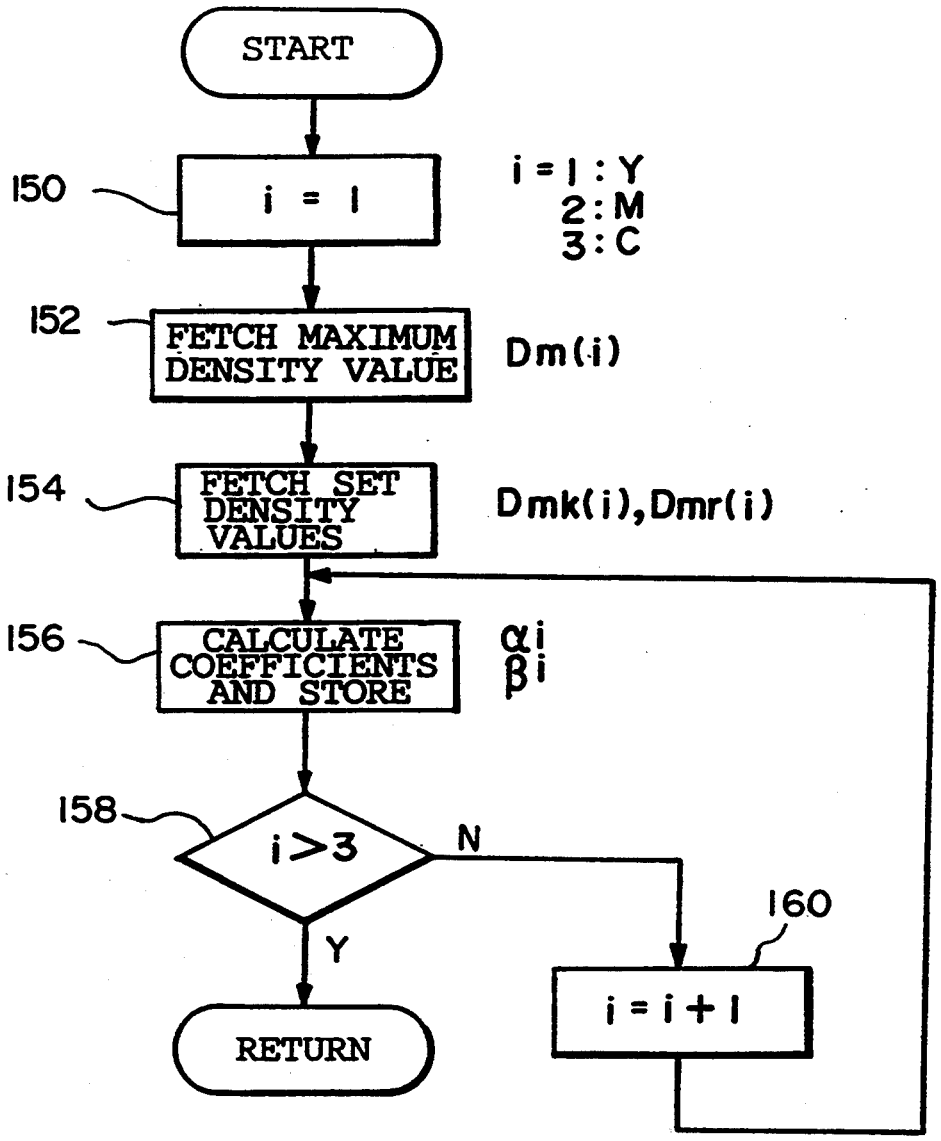
FIG. 9 is a flowchart illustrating a subroutine for converting image data of four colors to data of three hues of color.

Referring now to FIGS. 8 and 9, a description will be given of the operation of this embodiment in accordance with flowcharts.

First, when a main routine shown in FIG. 8 is started, an image-data conversion subroutine, which will be described later, is executed in Step 102. In this subroutine, a calculation is performed of coefficients for converting inputted image data (Y, M, C, K, and characters) to data (Y, M, and C) corresponding to colors at the time of recording. Incidentally, since the character data is the same as the black data, a description will be given hereafter of the black data.

Upon completion of the subroutine, the operation proceeds to Step 104 to fetch the image data D (i), and the operation proceeds to Step 106. In Step 106, the densities of the respective colors of Y, M, and C are calculated, and are stored in the frame memories 34 in Step 108. In Step 110, a determination is made as to whether or not the reading of all the pixel data has been completed. If it has not been completed, the operation returns to Step 104 to execute again the conversion of a one-picture plane portion of the image data. When the conversion of the image data is completed, the operation proceeds to Step 112 in which a one-line portion of the image data is read, and values for operating the thermal head 46 are outputted to the line buffer 42 by referring to the LUT 36. In Step 114, the one-line portion of the image is recorded for each color in correspondence with these operating values. Upon completion of the image recording of one line, the operation proceeds to Step 116 to determine whether or not the recording of one picture plane has been completed with respect to one color. If it has not been completed, the operation returns to Step 112 to repeatedly effect recording until the recording of one image plane is completed. When recording is effected by means of the thermal head 46, the controller 40 outputs a control signal to the switch 38 in such a manner that the LUT 36 of the hues to be developed during recording and the line buffer 42 are electrically connected to each other.

When the recording of one image plane is completed with respect to one color, the operation proceeds to Step 118 to determine whether or not the recording of image data has been completed with respect to all the colors (Y, M and C). If it has not been completed, in Step 120, ultraviolet light corresponding to the hue concerning which the recording of one image plane has been completed is radiated for a predetermined time. The operation then returns to Step 112 to effect the recording of the image repeatedly until the recording of the image data is completed with respect to all the colors (Y, M and C).

Referring now to FIG. 9, a description will be given of the subroutine for converting the image data (Y, M, C, K, and characters) to data (Y, M and C) corresponding to the colors to be developed during recording. In this subroutine, a calculation is made of coefficients for converting the black color to the three colors of Y, M and C, as explained above.

When this subroutine is started, the operation proceeds to Step 150, and 1 is set as a counter value i. As this counter value i, the colors Y, M and C correspond to 1, 2, and 3, respectively. In Step 152, the maximum density value Dm (i) with respect to each color-development layer of the thermal recording material 12 is fetched, and the operation then proceeds to Step 154. In Step 154, set values of density, i.e., the maximum value Dmk (i) of the density of black with respect to each color-development layer of the thermal recording material 12 and the maximum value Dmr (i) of the image density, are fetched.

When the fetching of the respective values is completed in Steps 152 and 154, the operation proceeds to Step 156 in which a calculation is performed of the coefficients $\alpha 1$ and $\beta 1$ including coefficients required for converting the maximum density values and set density values fetched to the three colors. The calculated coefficients $\alpha 1$ and $\oplus 1$ are stored in an unillustrated memory of the controller. These coefficients $\alpha 1$ and $\beta 1$ are obtained with respect to the respective three colors of Y, M and C (Steps 158 and 160). When the calculation of the coefficients is completed, this subroutine ends.

Thus, in this embodiment, recording in black can be effected with three scannings of Y, M and C by using a thermosensitive material having three thermal recording layers of Y, M and C without providing the thermal recording material with an additional thermosensitive layer of black, so that the process of recording in black can be omitted. Accordingly, since there is no need to provide the process of recording in black, processing can be simplified, and the apparatus can be arranged simply. In addition, when an image is recorded in such a manner as to obtain a black color by causing a plurality of color-development layers to undergo color development, recording is effected such that the density of each color-development layer becomes higher than a maximum density of each color of the image. Hence, a peculiar advantage is offered in that a sharp contrast is produced in the black color in the recorded image. Furthermore, since the recording of an image is not effected with the maximum density of the thermal recording material, the mixing of colors can be reduced in a color image. In addition, since the recording energy (quantity of heat) during image recording can be reduced, there is a peculiar advantage in that since the frequency with which the thermal head effects recording continuously in a high-temperature state is reduced, the life of the thermal head becomes prolonged.

Second Embodiment

In the foregoing first embodiment, a description has been given of an example in which different colors are developed by imparting thermal energy of different intensities to the thermal recording material 12 by using the thermal head 46. As a second embodiment, a description will be given of an example in which different colors are developed by applying light beams of different wavelengths to the thermal recording material.

First, a description will be given of a thermal recording layer 312 used in the second embodiment.

In this thermal recording material 312, as light beams of different ultraviolet wavelength regions are applied thereto, the development of hues corresponding to the areas irradiated with the light beams and the wavelength regions of the light beams is suppressed. Then, as the thermal recording material 312 is subjected to heating, the thermal recording material 312 undergoes heat development in areas where the light beams were not applied, thereby forming an image. Such thermal recording materials which have been proposed for use as photosensitive materials include, among others, the following: one in which two components of a two-component-type thermosensitive color-development medium are disposed by being separated from each other via microcapsules containing a photo-curing composition (Japanese Patent Application Laid-Open No. 89915/1977); one in which a layer containing a photopolymerizing composition and a vinyl monomer having an acidic group, an isolating layer, and a layer consisting of an electron-donating colorless dye are laminated (Japanese Patent Application Laid-Open No. 123838/1986); and one provided with a plurality of photosensitive layers which produce different colors, each photosensitive layer having a central wavelength (Japanese Patent Application Laid-Open Nos. 224930/1989 and 19710/1990).

Figure 5:
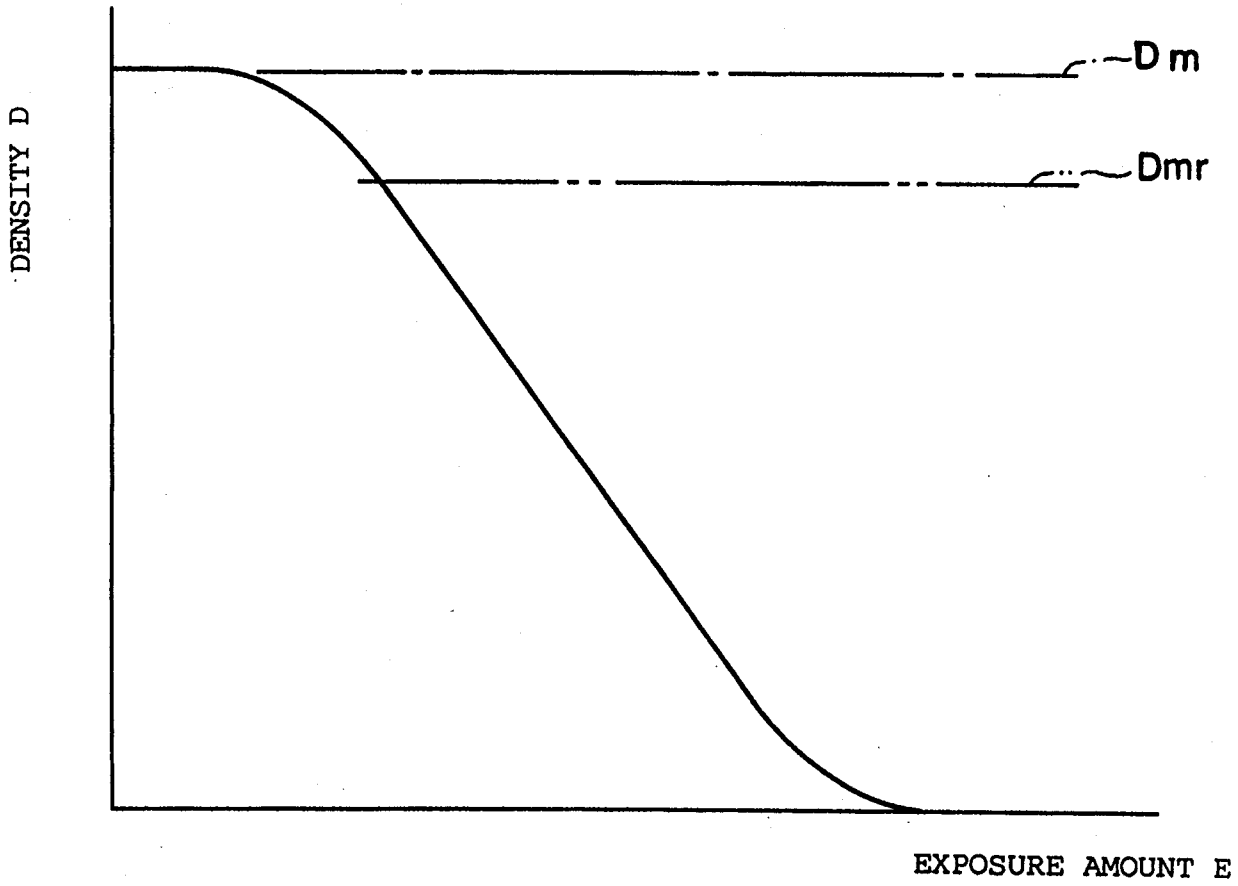
FIG. 5 is a diagram illustrating the relationship between the exposure amount and the color-development density in accordance with a second embodiment.

For instance, in a case where after a latent image is formed in a photo-curing composition by being exposed to ultraviolet light, a visible image is formed by heating, the color-development density D decreases with an increase in the exposure amount E, as shown in FIG. 5.

Next, a description will be given of the digital color printer 10 used in the second embodiment. Since this digital color printer 10 is substantially similar to that of the first embodiment, a detailed description will be omitted, and a description will be given centering on different arrangements. In the second embodiment, since a latent image corresponding to respective colors is formed by one exposure, there is no need to change over the transport passage between the discharging direction (in the rightward direction in FIG. 2) and the direction of the loop (in the upward direction in FIG. 2). In addition, as for the recording head, semiconductor lasers for causing respective colors to be developed in the thermal recording material are used in the exposing section instead of the thermal head 46 (FIG. 2).

Figure 10:
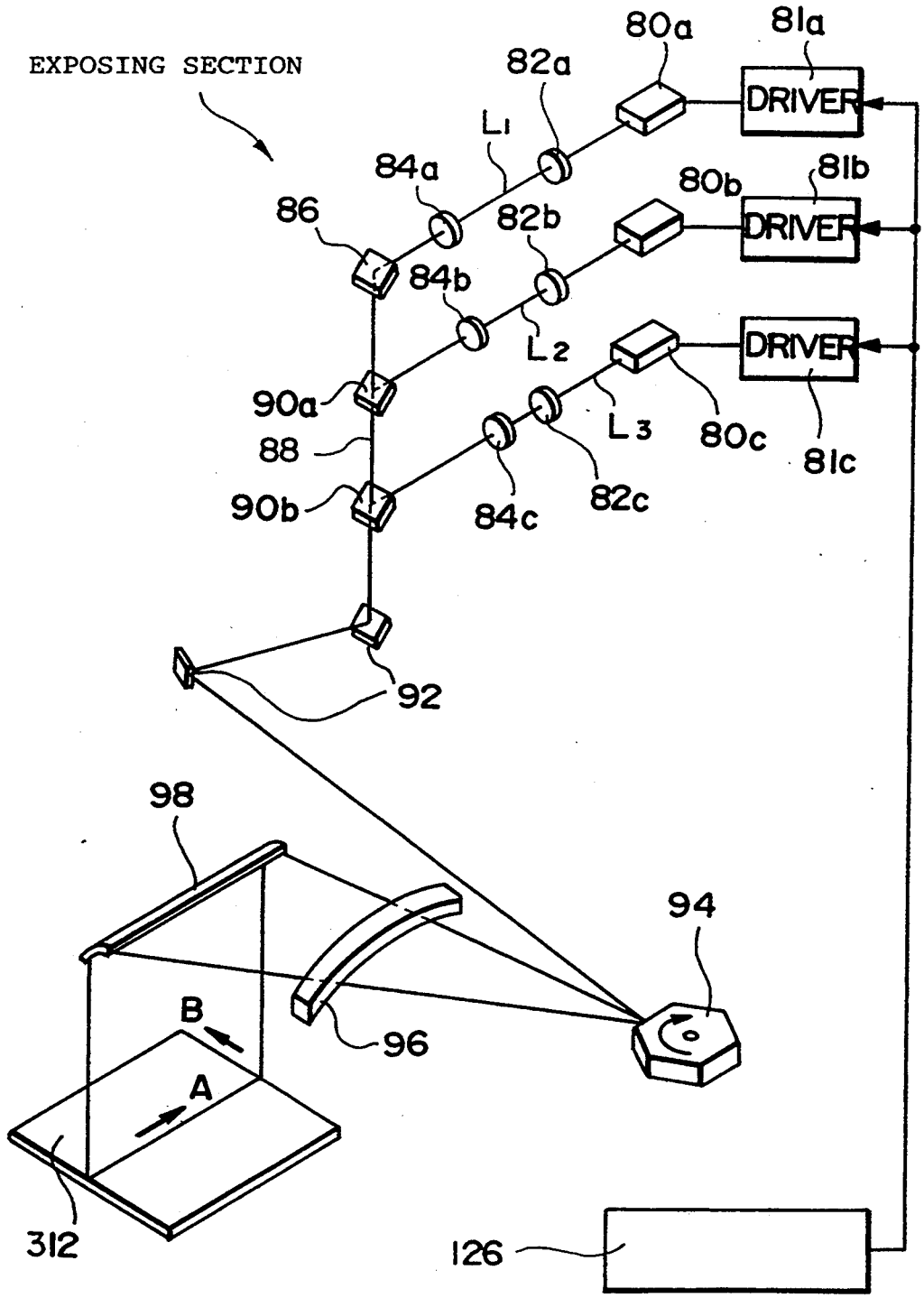
FIG. 10 is a perspective view illustrating the arrangement of an exposing section in accordance with the second embodiment.

As shown in FIG. 10, the exposing section comprises semiconductor lasers 80*a*, 80*b*, and 80*c*. These semiconductor lasers 80*a*, 80*b*, and 80*c* are driven by drivers 81*a*, 81*b*, and 81*c*. The semiconductor laser 80*a* outputs a light beam L1 in an ultraviolet region whose wavelength is, for instance, 355 nm. The semiconductor lasers 80*b* and 80*c* output light beams L2 and L3 whose wavelengths are, for instance, 390 nm and 410 nm, respectively. In addition, the wavelengths of the light beams L1, L2, and L3 correspond to the respective colors of Y, M and C which are developed as the thermal recording material 312 is exposed and undergoes heat development.

A collimator lens 82*a* for converting the light beam L1 into a parallel bundle of rays, a cylindrical lens 84a, and a reflecting mirror 86 are arranged in that order on the laser-beam emergent side of the semiconductor laser 80a. The laser beam L1 emitted from the semiconductor laser 80*a* is arranged to reach an optical path 88. In addition, A collimator lens 82*b*, a cylindrical lens 84*b*, and a dichroic mirror 90*a* are arranged in that order on the laser-beam emergent side of the semiconductor laser 80*b*. The light beam L2 emitted from the semiconductor laser 80*b* is arranged to reach the same optical path 88 as mentioned above. Similarly, a collimator lens 82*c*, a cylindrical lens 84*c*, and a dichroic mirror 90*b* are arranged in that order on the laser-beam emergent side of the semiconductor laser 80*c*. The light beam L3 emitted from the semiconductor laser 80*c* is arranged to reach the same optical path 88 as mentioned above.

The laser beams L1, L2, and L3 which have reached the same optical path 88 are reflected by two reflecting mirrors 92, and are then made incident upon a polygon mirror 94. The polygon mirror 94 rotates in the direction of the arrow in FIG. 10. The light beams L1, L2, and L3 reflected by this polygon mirror 94 are transmitted through an f8 lens 96, are reflected by a cylindrical mirror 98 for correcting plane inclination, and made to effect the main scanning of the thermal recording material 312 in the direction of arrow A. The thermal recording material 312 is transmitted in the sub-scanning direction (in the direction of arrow B) substantially perpendicular to the main-scanning direction by being driven by transport rollers and the like. Accordingly, light beams corresponding to a one-line portion of an image are radiated to the thermal recording material 312 by main scanning. Then, as the thermal recording material 312 is sequentially subjected to sub scanning for a one-image portion, light beams corresponding to the image are applied to the thermal recording material 312.

The controller 26 is electrically connected to the drivers 81*a*, 81*b*, and 81*c*, which are, in turn, electrically connected to the semiconductor lasers. This digital color printer has a heater 48 (FIG. 11), and an image is formed on the thermal recording material 312 by the heat of the heater 48. At that time, the color development of portions irradiated with the light beams from the semiconductor lasers is suppressed.

Figure 11:
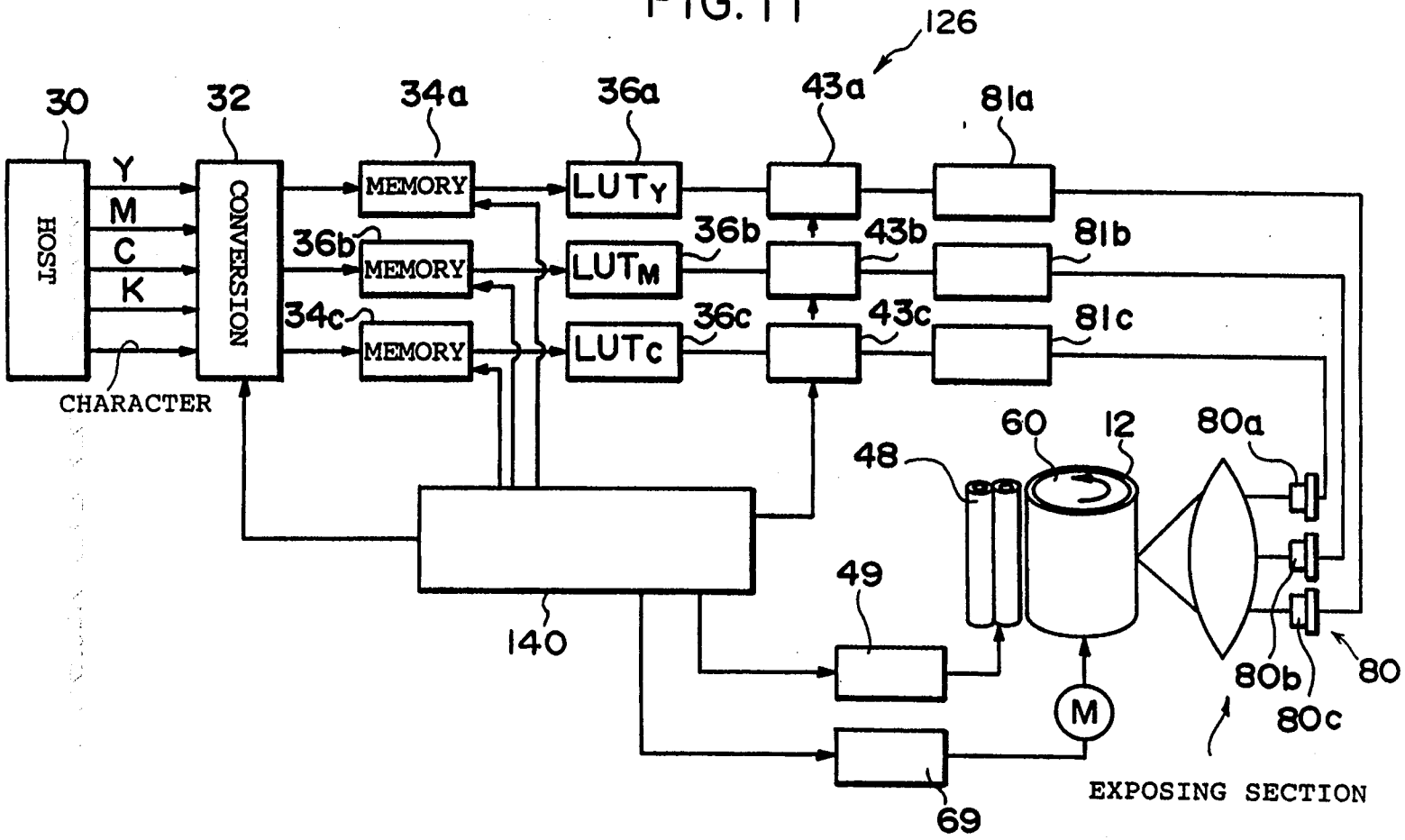
FIG. 11 is a block diagram illustrating a configuration of a controller in accordance with a second embodiment.

Referring next to FIG. 11, a description will be given of a controller 126 of the second embodiment. Since the arrangement of the controller 126 of the second embodiment is identical to that of the controller 26 of the first embodiment up to the LUTs 36*a*, 36*b*, and 36*c*, a detailed description will be omitted by denoting the same components by using the same reference numerals, and a description will be given of components which follow the LUTs 36.

The YMC signals outputted from the frame memories 34, i.e., image density data, are converted to driving values of Y, M and C colors corresponding to color-development densities by the lookup table (LUT) 36, and are then outputted to buffers 43*a*, 43*b*, and 43*c* corresponding to the Y, M and C colors. Here, the respective buffers 43*a*, 43*b*, and 43*c* are electrically connected to a controller 140, and the values stored in the buffers are supplied to the drivers 81*a*, 81*b*, and 81*c* in response to signals from the controller 140.

The drivers 81*a*, 81*b*, and 81*c* drive the semiconductor lasers 80*a*, 80*b*, and 80*c* in correspondence with the values inputted to the drivers 81*a*, 81*b*, and 81*c*. As a result, light beams are radiated to the thermal recording material 312, thereby recording an image.

The controller 140 is electrically connected to the motor 68 via the driver 69, and sends a signal for rotating the platen roller 60. In addition, the controller 140 is electrically connected to the heater 48 via a heater driver 49, and controls the temperature of the heater 48 to a predetermined level. As the thermal recording material 312 passes by the heater 48, the image of the thermal recording material 312 recorded by the semiconductor lasers is developed.

Although, in the above-described second embodiment, drivers are used to drive the semiconductor lasers, it is possible to use a modulation element (e.g. an acousto-optic element) or the like for directly modulating the intensity of light as well as a modulating circuit.

Next, a description will be given of the LUT. In the thermal recording material 312 used in the second embodiment, the characteristic of the image density data vs. the color-development density D does not become optimum as in the case of the first embodiment. As a result, even if exposure is effected to obtain desired color-development densities, the color-development densities of the thermal recording material 312 become different, so that an image of desired densities cannot be obtained. For this reason, in the same way as in the first embodiment, a table is prepared in such a manner that the characteristic of the color-development density D with respect to the exposure E becomes optimum. Namely, the characteristic of driving values (driving current or the like) of light beams which make it possible to obtain optimum color-development densities in correspondence with the image density data is prepared, and this characteristic is set as the LUT.

Figure 12:
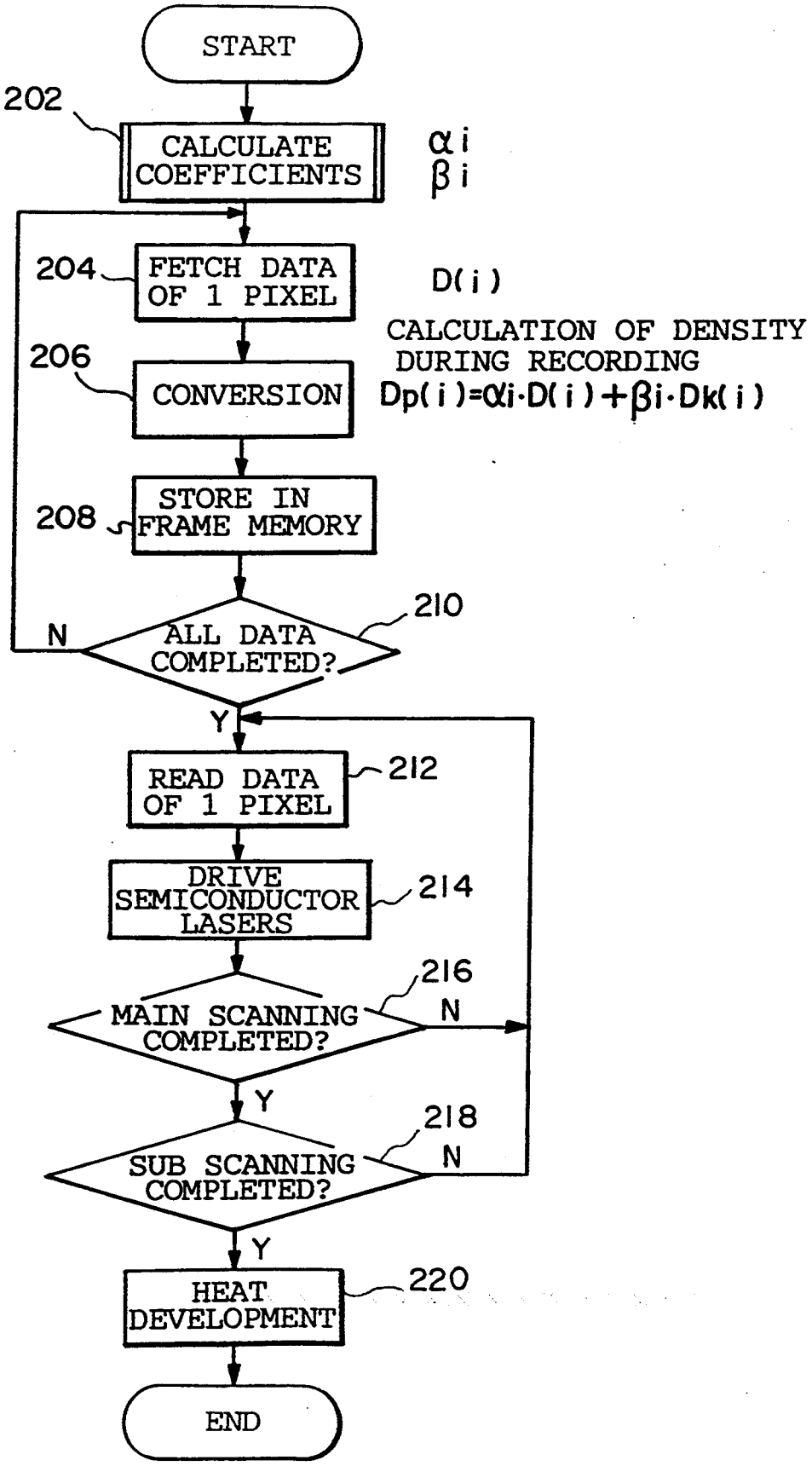
FIG. 12 is a flowchart illustrating a main routine for control in accordance with the second embodiment.

Referring now to FIG. 12, a description will be given of the operation of the second embodiment in accordance with a flowchart stored in the controller 126.

First, when the main routine shown in FIG. 12 is started, the above-described image-data conversion subroutine is executed in Step 202. In this subroutine, as described in the first embodiment, a calculation is performed of coefficients for converting inputted image data (Y, M, C, K, and characters) to data (Y, M, and C) corresponding to colors at the time of recording. Incidentally, since the character data is the same as the black data, a description will be given hereafter of the black data.

Upon completion of the subroutine, the operation proceeds to Step 204 to fetch the image data D (i), and the operation proceeds to Step 206. In Step 206, the densities of the respective colors of Y, M, and C are calculated, and are stored in the frame memories 34 in Step 208. In Step 210, a determination is made as to whether or not the reading of all the pixel data has been completed. If it has not been completed, the operation returns to Step 204 to execute again the conversion of a one-picture plane portion of the image data.

When the conversion of the image data is completed, the operation proceeds to Step 212 in which the image data of one pixel is read, and values for operating the semiconductor lasers 80 are outputted to the buffers 43 by referring to the LUT 36. In Step 214, as the semiconductor lasers 80*a*, 80*b*, and 80*c* corresponding to the colors to be developed in correspondence with these operating values are simultaneously driven, the recording of one pixel of the image is effected. Upon completion of the recording of one pixel of the image, the operation proceeds to Step 216 to determine whether or not the application of light beams for one line (main scanning) has been completed. If it has not been completed, the operation returns to Step 212, and recording is effected repeatedly until the recording of one line is completed. Upon completion of the recording of one line, the operation proceeds to Step 218 to determine whether or not the application of light beams for sub scanning has been completed. If it has not been completed, the operation returns to Step 212, and recording is effected repeatedly until the irradiation of one picture plane is completed. Upon completion of the irradiation of one picture plane, the operation proceeds to Step 220 in which the thermal recording material 312 is subjected to heat development, thereby allowing an image to be formed on the thermal recording material 312.

Thus, in this second embodiment, as the three semiconductor lasers corresponding to the colors to be developed in the thermal recording material 312 are simultaneously turned on to effect scanning, the recording of the respective hues to be developed in the thermal recording material 312 is effected simultaneously. As a result, the process of recording in black can be omitted, and an image can be recorded by one scanning of the image plane without effecting recording in correspondence with the colors to be developed. Accordingly, the processes can be simplified.

In addition, since the exposure amount is determined in such a manner that the density of each color-development layer with respect to the density of black becomes higher than the maximum density of each color of the image, a peculiar advantage is offered in that a sharp contrast is produced in the black color in the recorded image. Furthermore, since the color-development densities of the thermal recording material 312 are controlled by controlling the exposure amounts of the light beams, it is possible to effect subtle control of the exposure amount. As a result, the image can be expressed with subtle tones which cannot be obtained by thermal recording using the recording head such as the thermal head. In addition, since the light beams of wavelengths corresponding to the color-development layers of the thermal recording material 312 are applied, colors corresponding to the wavelengths of the light beams are developed in the thermal recording material 312. Since the wavelength of the light beam can be easily selected, the color is developed in correspondence with the wavelength of each light beam. Hence, there is a peculiar advantage in that the mixing of colors is reduced in the color image formed on the thermal recording material 312.

Although, in the above-described embodiment, a description has been given of the case where the color of the characters is black, the present invention is not limited to the same, and can be easily applied even in cases where the color of the characters is other than black. That is, in cases where the color of the characters is other than black, the data after the conversion of the aforementioned three colors of Y, M, and C becomes the data corresponding to the color of the characters. Furthermore, since the density of each of the colors of Y, M, and C is set to become higher than the maximum density of each color of the image, a sharp contrast is produced in the color of the characters in the recorded image. In addition, although in the above-described embodiment a description has been given of an example in which conversion coefficients at the time when the image data is converted to data of the three colors of Y, M, and C on the basis of five kinds of data (Y, M, C, K, and characters) are determined by calculation, it is possible to adopt an electrical circuit which combines a digital-analog conversion circuit, an amplifier circuit, and so on.

The present inventors conducted an experiment by effecting conversion based on data shown in Table 2 below, and it was experimentally confirmed that it is possible to obtain excellent results in which a sharply contrasted image can be recorded as the black color and characters.

TABLE 2

| Hue | Dmr | Dmk | Dmc | Dm |
|---|---|---|---|---|
| Y | 1.5 | 2.0 | 2.0 | 2.0 |
| M | 1.5 | 2.0 | 2.0 | 2.0 |
| C | 1.5 | 2.0 | 2.0 | 2.2 |

In addition, although in the above-described embodiments a description has been given of an example in which a color image is recorded on the thermal recording material through a subtractive mixture, the present invention is not limited to the same, and can be easily applied to a case where a color image is recorded through an additive mixture. For instance, the present invention can be applied to a color display in which R, G, and B colors are developed. Since the color display shows the black color when it is turned off, if the luminescence is determined such that the luminance concerning black characters and image becomes lower than the luminance of each color of the image, an advantage can be obtained in that a sharp contrast can be produced in the black color in the displayed image. In addition, since, in the color display, the white color is formed by the mixing of the R, G, and B colors, the color display can be realized by substituting the density of black used in the above-described embodiment for the density of white. Accordingly, if the luminescence is determined such that the luminance of each color development concerning a white image and characters becomes higher than the maximum luminance of each color of the image, an advantage can be obtained in that a sharp contrast can be produced in the white color in the displayed image.

As described above, in accordance with the first and second embodiments, since the density of black becomes higher than the density of each color of the image, it is possible to obtain the advantage that a sharp contrast is produced in the black color formed on the thermal recording material.

Furthermore, since the density of the recorded characters becomes higher than the density of each color of the image, it is possible to obtain the advantage that the characters in the recorded image are prevented from becoming difficult to discriminate, and a sharp contrast is produced in the characters formed on the thermal recording material.

Moreover, by using the above-described image recording apparatus, it is possible to use a thermosensitive material having three thermal recording layers without needing to provide an additional thermosensitive layer of black. At the same time, since there is no need to provide the process of recording in black, the processing can be simplified, so that the apparatus can be arranged simply. Furthermore, since cases are reduced where the recording head is kept at a high temperature for obtaining a maximum density for the thermal recording material, there is an advantage in that a long life of the thermal recording head is ensured.

Third Embodiment

Figure 13:
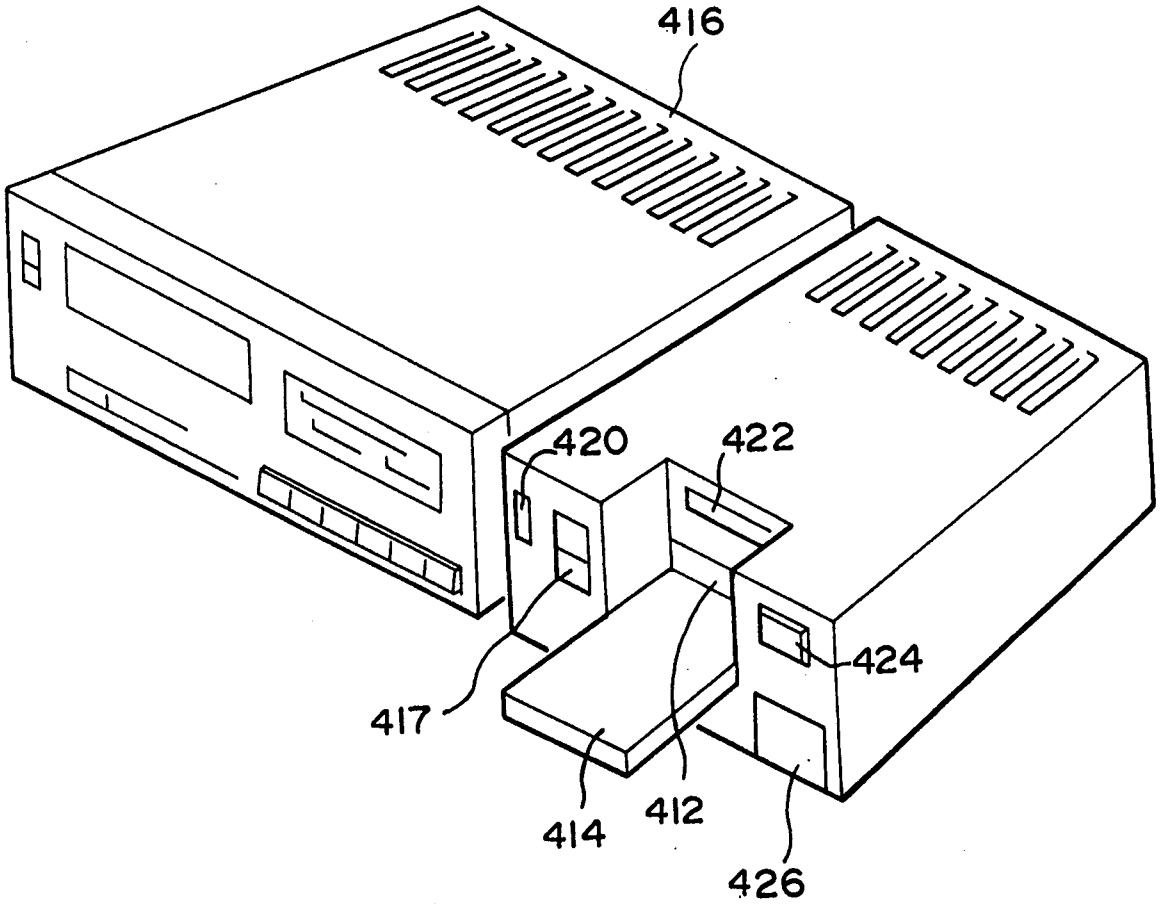
FIG. 13 is a perspective view illustrating the outer appearance of an image recording apparatus in accordance with a third embodiment.

FIG. 13 schematically illustrates the structure of an image recording apparatus in accordance with a third embodiment.

A slit-like insertion and discharge port 412 for a thermal recording material 310 is provided in a front surface of the image recording apparatus, and unprocessed thermal recording material 310 is inserted manually by the operator. A tray 414 extends from the insertion and discharge port 412 toward this side in FIG. 13, so that the thermal recording material 310 can be placed on this tray 414 and can be inserted as placed on the tray 414. The thermal recording material 310 for which thermal processing has been completed can be discharged through this insertion and discharge port 412, and the tray 414 also serves as a tray for receiving the already processed thermal recording material discharged. In addition, the tray 414 can be accommodated in the apparatus as it is inserted in the direction of the insertion and discharge port 412.

A VTR 416, for example, is connected to the image recording apparatus, and image recording signals at the time of image recording by a thermal head 332 (see FIG. 15), which will be described later, are prepared on the basis of image signals from this VTR 416. As another image signal source that can be connected to the image recording apparatus, it is possible to cite a CCD camera or the like.

A power switch 420, a display unit 422 for displaying the number of prints and the like, and a print button 424 are provided on a front panel 417 provided with the aforementioned insertion and discharge port 412. In addition, an openable sub-cover 424 is provided below the print button 424, and an unillustrated knob for fine adjustment of picture quality, and the like are attached behind the sub-cover 424.

Figure 14:
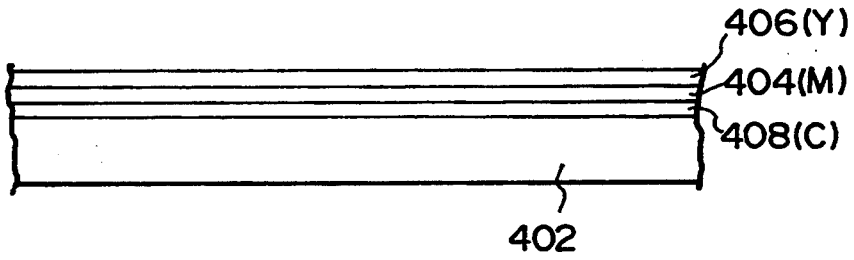
FIG. 14 is a cross-sectional view illustrating a multicolor thermal recording material used in the third embodiment.

As shown in FIG. 14, the thermal recording material 310 is arranged such that a cyan dye layer (hereafter referred to as the C dye layer) 408, a magenta dye layer (hereafter referred to as the M dye layer) 404, and a yellow dye layer (hereafter referred to as the Y dye layer) 406 are, in that order beginning with a lowermost layer, superposed on one surface of a polyethylene terephthalate film (hereafter referred to as the PET) 402 which is a transparent base. All of these layers are transparent. The Y dye layer 406 and the M dye layer 404 are of a photochemically fixing type, and are of such a nature that these layers, once respectively irradiated with light of a 420 nm wavelength and a 365 nm wavelength, do not change even on heating.

Figure 15:
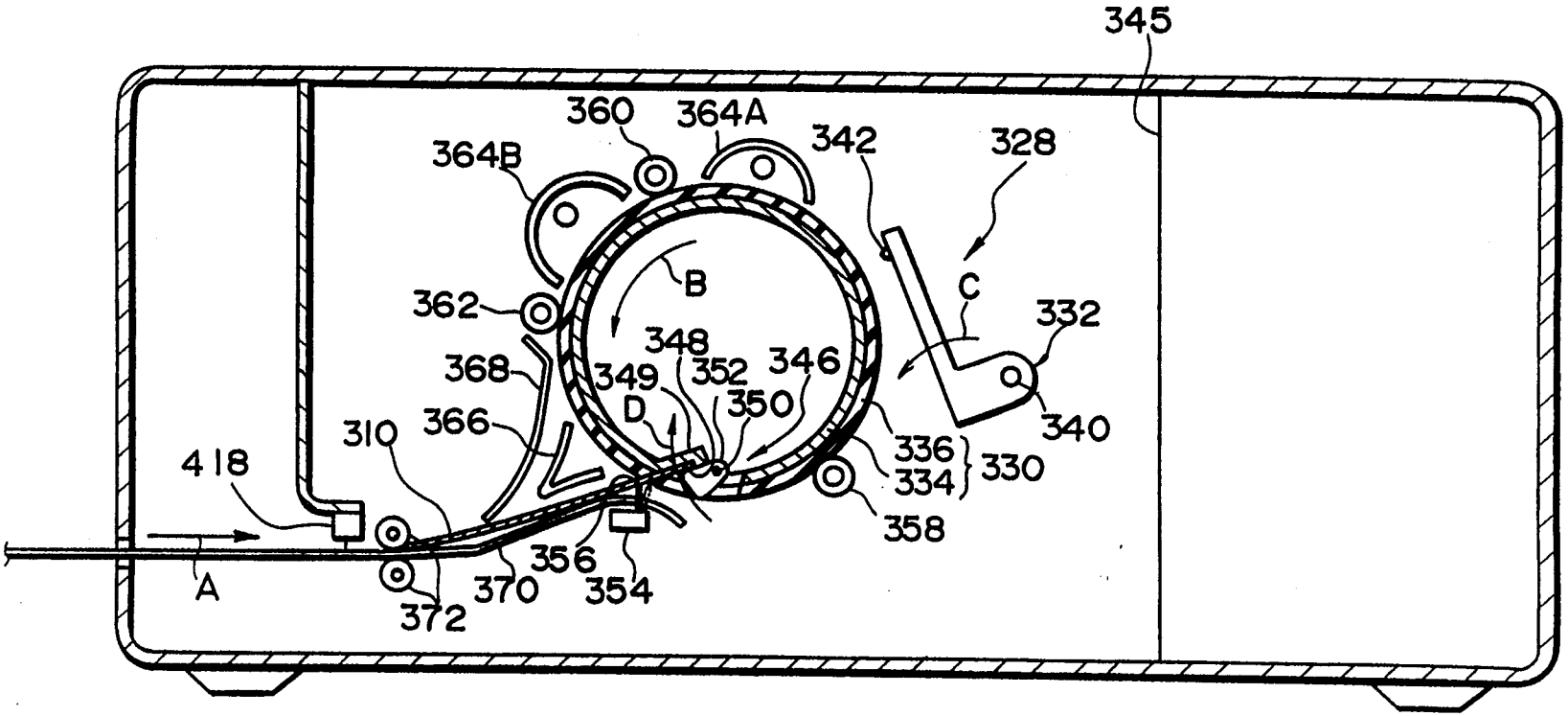
FIG. 15 is a cross-sectional view illustrating an internal arrangement of the image recording apparatus in accordance with the third embodiment.
Figure 16:
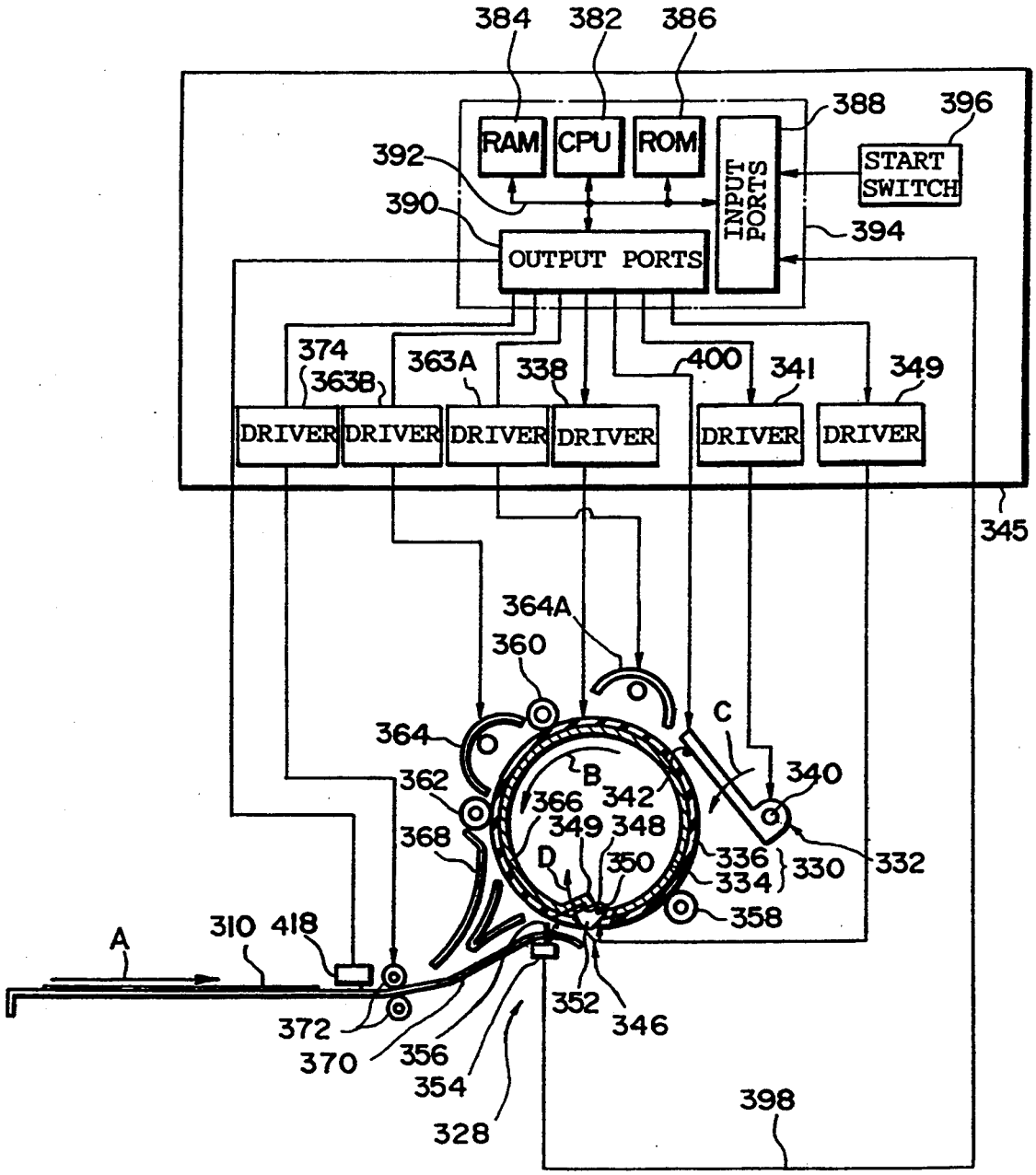
FIG. 16 is a control block diagram in accordance with the third embodiment.
Figure 17:
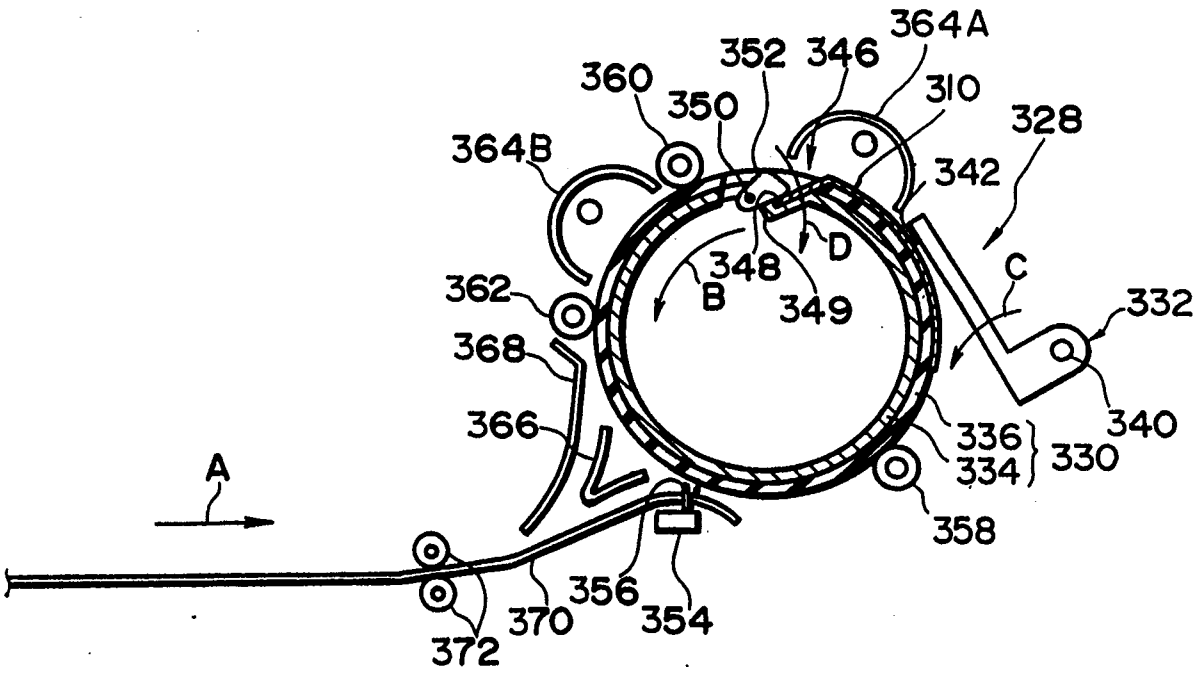
FIG. 17 is an enlarged view of a support drum and its vicinity in accordance with the third embodiment.

As shown in FIGS. 15 to 17, when the leading end of the thermal recording material 310 is inserted through the insertion and discharge port 412 into the apparatus, the thermal recording material 310 is detected by a limit switch 418. Subsequently, the thermal recording material 310 is nipped by a pair of transport rollers 372 driven by the driving force of a driver 374, is transported while being guided by a guide plate 370, and is guided to a heat processing section 328.

The heat processing section 328 is provided with a support drum 330, which is a rotating member, and a line-type thermal head 332, which is a recording head. The thermal recording material 310 is heated by the thermal head 332 in a state in which the thermal recording material 310 is wound around this support drum 330. The support drum 330 is formed of a metallic cylindrical member 334, and a resilient member 336 is wound around an outer periphery thereof. The support drum 330 is rotated at a constant velocity in the direction of arrow B in FIGS. 15 to 17 by the driving force of a driver 338. The support drum 330 serves to make the thermal recording material 310 wound around the support drum 330 to consecutively correspond to the thermal head 332.

One side of the thermal head 332 is pivotally supported on a frame of the apparatus via a shaft 340, and is rotated in the direction of arrow C in FIGS. 15 to 17 and in the opposite direction thereto about this shaft 340 by the driving force of a driver 341. Heating elements 342 disposed on the other side of the thermal head 332 are moved into contact with and away from the thermal recording material 310 wound around the support drum 330. Image signals are outputted to the heating elements 342 from a controller 345 when the heating elements 342 are brought into contact with the thermal recording material 310, so as to form an image on the thermal recording material 310 by heating in correspondence with image signals 400.

The thermal recording material 310 transported to the heat processing section 328 by transport rollers 326 is guided by the guide plate 370 along the transport passage, and reaches a recessed portion 348 constituting a part of a holding portion 346 provided around the outer periphery of the support drum 330. A latch pawl 352, which constitutes the holding portion together with the recessed portion 348, is pivotally supported in the recessed portion 348 via a shaft 350 disposed parallel with the rotating shaft of the support drum 330. This latch pawl 352 serves to hold one end of the thermal recording material 310 as the latch pawl 352 rotates in the direction of arrow D in FIGS. 15 to 17 via the shaft 350 by the driving force of a driver 349 when one end of the thermal recording material 310 guided by the guide plate 370 is accommodated in the recessed portion 348. The thermal recording material 310, when held by this latch pawl 352, is consecutively wound around the outer periphery of the support drum 330 as the support drum 330 rotates.

The timing at which the latch pawl 352 holds the thermal recording material 310 is provided by a limit switch 354 disposed midway in the transport passage of the thermal recording material 310. Namely, when the thermal recording material 310 reaches the position of this limit switch 354, an actuator 356 of the limit switch 354 interferes with the thermal recording material 310, and changes over a contact (in this embodiment, a normally open type is used as the limit switch 354, and is set to an on state when in contact with the thermal recording material 310). On (high level) and off (low level) signals from the limit switch 354 are supplied to the controller 345. The controller 345 is adapted to effect the operation (rotation in the direction of arrow D in FIG. 15) of the latch pawl 352 after the lapse of a predetermined time (at least after the leading end of the thermal recording material 310 has reached an innermost portion of the recessed portion 348) set in correspondence with the traveling speed of the thermal recording material 310. As a result, in a state in which the thermal recording material 310 is held by the latch pawl 352, the position of the thermal recording material 310 relative to the support drum 330 is constantly fixed, with the result that positioning is effected accurately.

Idle rollers 358, 360, and 362 are disposed at the outer periphery of the support drum 330 at a plurality of locations (three in this embodiment). The thermal recording material 310 is wound closely around the outer periphery of the support drum 330 by means of the support drum 330 and these idle rollers 358, 350, and 362. In addition, light sources 364A and 364B, which are electrically connected to the controller 345 via drivers 363A and 363B, are disposed on the downward side of the support drum 330 as viewed in the rotating direction thereof at a position for heating the thermal recording material 310 by the thermal head 332. These light sources 364A and 364B are adapted to emit light to the thermal recording material 310. The wavelengths of the light from these light sources 364A and 364B are set to be 420 run and 365 nm, respectively. The light source 364A is used for fixing the Y dye layer 406 of the thermal recording material 310, while the light source 364B is used for fixing the M dye layer 404. Namely, in this embodiment, the support drum 330 is adapted to undergo three revolutions continuously after starting the rotation. During the first revolution of the thermal recording material 310, the heat processing of the Y dye layer 406 is effected by the thermal head 332, and fixing is carried out immediately after this processing.

During the next revolution of the support drum 330, i.e., during the second revolution, the M dye layer 404 (see FIG. 14) disposed below the Y dye layer 406 is subjected to heat processing and is fixed, and during the third revolution the C dye layer 408 is subjected to heat processing.

It should be noted that the energy (quantity of heat) which the thermal recording material 310 receives from the heating elements 342 is controlled by the controller 345 such that the energy is set to a weak level during the first revolution of the support drum 330, during which the M dye layer 404 and the C dye layer 408 in the lower layers remain unaffected. During the second revolution, the energy is set to a medium level, and during the third revolution, the energy is set to a strong level.

The time duration of the aforementioned fixation includes both a duration for effecting the fixing of unnecessary color-development components, i.e., for suppressing the subsequent color development of portions which were not colored by the thermal head 332, and a duration for effecting uncoloration so as to prevent coloration due to a change with time. These durations have different characteristics (gradients), respectively.

Figure 18:
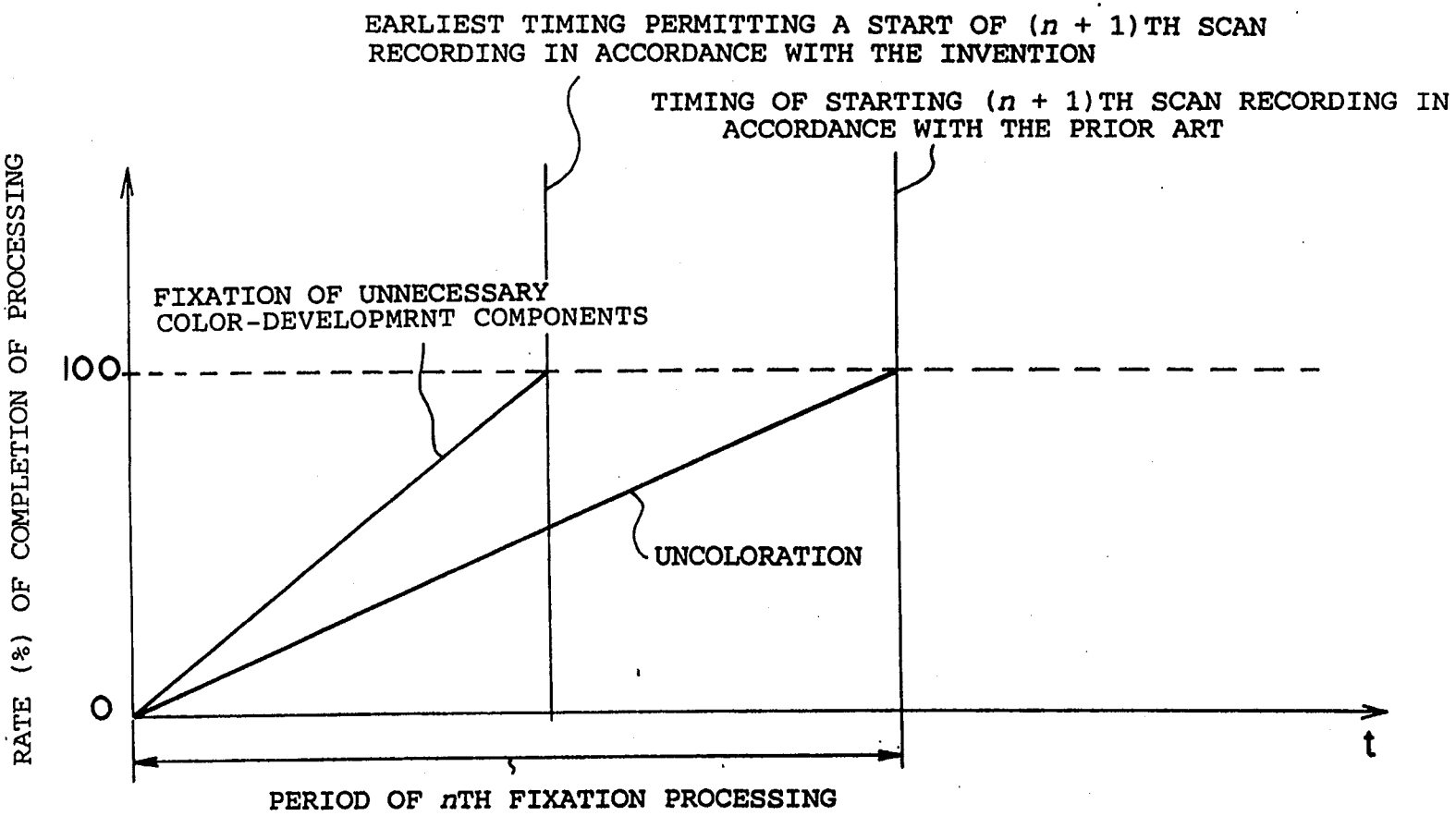
FIG. 18 is a characteristic diagram illustrating the details of processing effected during fixation processing in the third embodiment.

As shown in FIG. 18, the uncoloration process for preventing colorations due to a change with time is not completed at a point of time when the fixing of the unnecessary color-development components is completed. However, at this point of time, the color development of that color-development layer is controlled. For this reason, in this embodiment, the heat processing of an ensuing color-development layer is started at least after the completion of the fixing of the unnecessary color-development components.

Accordingly, during an nth revolution, i.e., when the heat processing of the Y dye layer 406 is started by the thermal head 332, the light source 364A downstream of this thermal head 332 is turned on. The rotational speed of the support drum 330 for allowing the thermal recording material 310 to pass by this light source 364A is adjusted to the time of completion of the fixation processing of the unnecessary color-development components shown in FIG. 18. As a result, the processing speed is increased. It should be noted that, in correspondence with this increased speed, it is necessary to increase the duty of the maximum power of the thermal head 332 so as to secure the energy to be applied from the thermal head 332 to the thermal recording material.

After the support drum 330 undergoes one revolution, the color-development layer for the (n+1)th revolution, i.e., the M dye layer, 404, is subjected to heat processing during the second revolution. At this time, the light source 364A continues to be turned on for a duration necessary at least for the completion of the aforementioned uncoloration process.

Similarly, when the heat processing of the M dye layer 404 is started by the thermal head 332, the light source 364B downstream of the light source 364A is turned on. Normally, since the fixation processing characteristics of the color-development layers are similar, the support drum is rotated at a speed equivalent to the aforementioned rotational speed, and the support drum is made to undergo one revolution at a point of time when the fixation of the unnecessary color-development components of the M dye layer 404 is completed. Then the heat processing of the ensuing C dye layer 408 is effected.

Upon completion of the heat processing of the C dye layer 408, the holding of the thermal recording material 310 by the holding portion 346 at the position of the idle roller 362 is canceled. Consequently, the thermal recording material 310 is guided between guide plates 366 and 368, and reaches the insertion and discharge port 412.

The controller 345 is provided with a microcomputer 394 comprising a CPU 382, a RAM 384, a ROM 386, input ports 388, and output ports 390, and buses 392 including a data bus connecting them and a control bus. Electrically connected to the input ports 388 are the print button 424 and the limit switch 418. A series of heat processing is conducted through the operation of this print button 424 and the detection of the thermal recording material 310 by the limit switch 418. In addition, a signal line 398 from the aforementioned limit switch 354 is also electrically connected to the input ports 388.

The support drum 330, the thermal head 332, the latch pawl 352, the light sources 364A and 364B, and the transport rollers 372 are electrically connected to the output ports 390 via the drivers 338, 341, 349, 363A, 363B, and 374, respectively, and the driving of each of these components is controlled. In addition, the signal line 400 for supplying the image signals to the thermal head 332 is also electrically connected to the output ports 390.

The operation of this embodiment will be described hereafter.

The print button 424 is operated, and the thermal recording material 310 is inserted through the insertion and discharge port 412 and is moved while being guided by the guide plate 370. When the limit switch 418 is turned on, the transport rollers 372 start driving and the thermal recording material 310 is transported by a predetermined amount. It should be noted that, when the print button 424 is not operated, the transport rollers 372 are not driven even if the limit switch 418 is turned on, and the driving is started by waiting for the operation of the print button 424.

When the thermal recording material 310 is further transported, the thermal recording material 310 is brought into contact with the actuator 356 of the limit switch 354. Here, when the limit switch 354 is turned on, a high-level signal is inputted to the input ports 388, and after the lapse of a predetermined time the latch pawl 352 is rotated in the direction of arrow D. During this predetermined time, the leading end portion of the thermal recording material 310 is accommodated in the recessed portion 384 of the support drum 330, and the leading end thereof abuts against the retaining portion 349, and the leading end portion thereof is held by the latch pawl 352.

when the leading end portion of the thermal recording material 310 is held by the latch pawl 352, the support drum 330 starts to rotate in the direction of arrow B (first revolution). The first heat processing control is effected at this time. That is, when the holding portion 346 passes by the heating elements 342 of the thermal head 332, a driving signal is outputted from the output ports 390 via the driver 341, whereupon the thermal head 332 is rotated in the direction of arrow C about the shaft 340, causing the heating elements 342 to be brought into contact with the thermal recording material 310. Consequently, the support drum 330 is rotated in a state in which the heating elements 342 abut against the thermal recording material 310, and image signals are outputted to the heating elements 342 in conjunction with that rotation.

The quantity of heat of the heating elements 342 is set to the weak level, the thermal recording material 310 is heated in response to the image signals, and only the Y dye layer 406 is made to develop its color. Upon completion of the heat processing by the heating elements 342, the thermal head 332 is rotated in the opposite direction to the direction of arrow C about the shaft 340, causing the heating elements 342 to move away from the thermal recording material 310.

Then, the light of the 420 nm wavelength is radiated from the light source 364A onto the image plane of the thermal recording material 310. As a result, the Y dye layer 406 is fixed. Here, the rotational speed of the support drum 330 is controlled such that the time duration of this fixation processing is set in such a manner as to coincide with the duration required for completion of the fixation processing of the unnecessary color-development components shown in FIG. 18.

For this reason, at the point of time when the support drum 330 has undergone one revolution, the fixation processing (uncoloration) of the Y dye layer 406 has not been completed, but since the fixation of the unnecessary color-development components has been completed, the Y dye layer 406 does not undergo color development even if the ensuing M dye layer 404 is subjected to heat processing. Hence, an interval of heat processing between the Y dye layer 406 and the M dye layer 404 can be shortened.

Next, the operation proceeds to the second revolution without a pause, and the heat processing of the M dye layer 404 is effected. Namely, the quantity of heat for heat processing by the heating elements 342 is changed over to the medium level, and processing similar to the heating of the Y dye layer 406 is carried out. Thus, the thermal recording material 310 is heated in response to the image signals, causing only the M dye layer 404 to develop its color.

At that time, the light source 364A continues to be turned on, and is lit at least until the uncoloration is completed. In that case, since the upper Y dye layer has already been fixed, the Y dye layer does not change. In addition, since there is no change in the position of the thermal recording material 310 relative to the support drum 330, color development can be effected accurately without causing an offset of colors between the images of the Y dye and the M dye.

As for the thermal recording material 310 for which the heat processing of the M dye layer has been completed, the light of the 365 nm wavelength is radiated thereto by the light source 364B, thereby fixing the M dye layer 404.

Subsequently, the operation proceeds to the third revolution to effect the heat processing of the C dye layer 408. That is, the quantity of heat for heat processing by the heating elements 342 is changed over to the strong level, and the thermal recording material 310 is heated in response to the image signals, causing only the C dye layer 408 to develop its color.

In the same way as the timing for starting the heat processing of the M dye layer 404, the timing for starting the heat processing of the C dye layer 408 is set to the timing when the fixation of the unnecessary color-development components of the M dye layer 404 is completed. Hence, the processing period can be reduced.

Upon completion of the heat processing of the respective color-development layers, the heating elements 342 of the thermal head 332 are moved away from the thermal recording material 310, and after the lapse of a predetermined time, the holding portion 364 passes by the idle roller 362. At this point of time, the nipping of the thermal recording material 310 by the holding portion 346 is canceled, and the thermal recording material 310 is transported between the guide plates 366 and 368 in conjunction with the rotation of the support drum 330.

The thermal recording material 310 placed between the guide plate 366 and 368 is guided by the guide plate 370 and is nipped by the transport rollers 372 which rotate reversely. As the thermal recording material 310 is transported by a predetermined amount by the transport rollers 372, the thermal recording material 310 is fed out through the insertion and discharge port 412, and is placed on the tray 414. This completes the heat processing of one sheet of the thermal recording material 310.

Thus, in this embodiment, the characteristic of the fixing of the unnecessary color-development components and the characteristic of uncoloration, which are included in the nth fixation processing, are separated from each other, and the fixation processing for uncoloration is continued after the starting of the (n+1)th heat processing. Hence, the nth fixation processing and the (n+1)th heat processing can be operated in an overlapping manner, so that the overall recording period can be shortened.

Figure 19A:
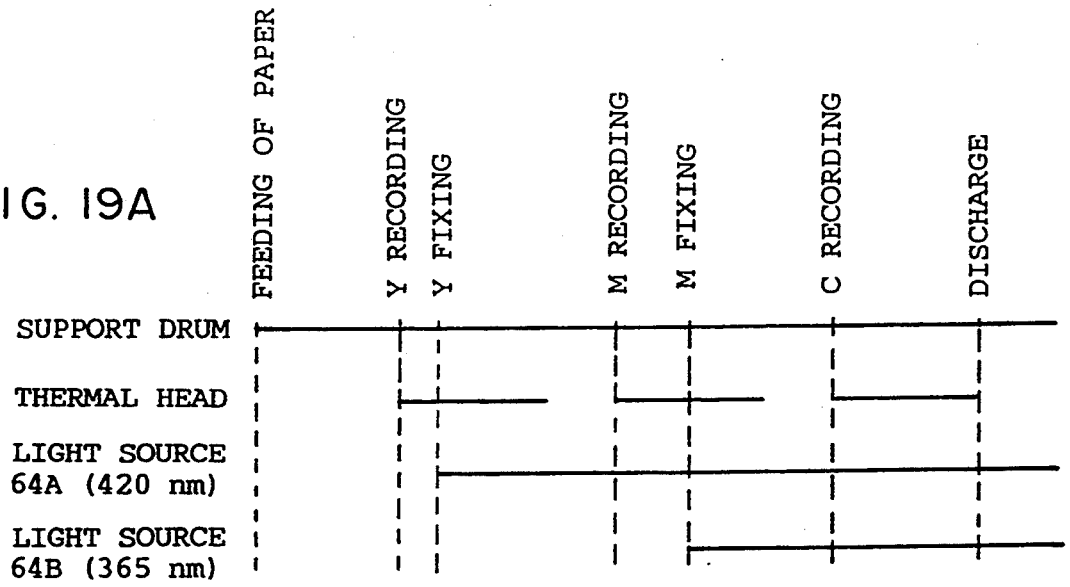
FIGS. 19A, 19B, and 19C are a timing chart of Experimental Example 1, a timing chart of Experimental Example 2, and a timing chart of Experimental Example 3, respectively.
Figure 19B:
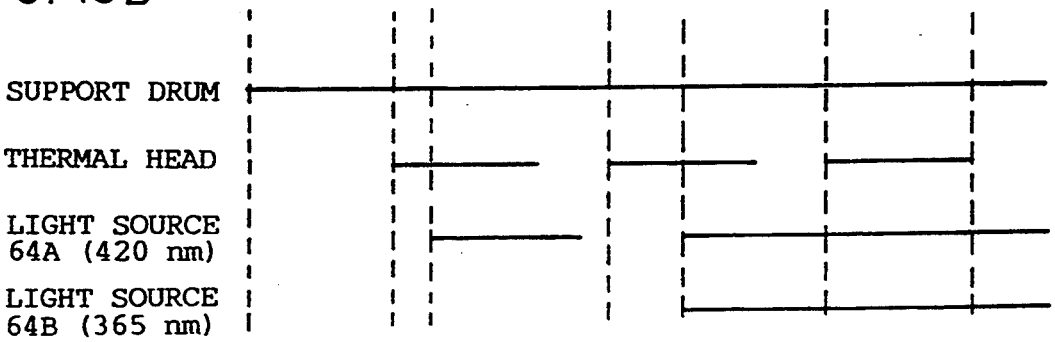
Figure 19C:
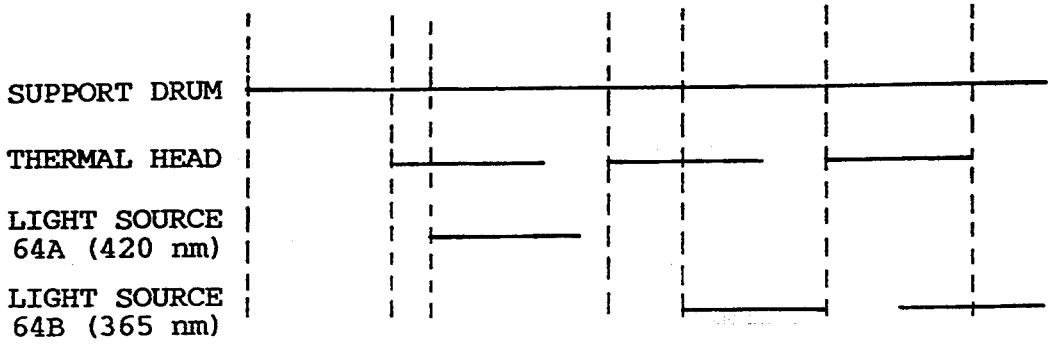

FIGS. 19A to 19C show the results of an experiment which was conducted on the basis of this embodiment.

Experimental Example 1

As shown in FIG. 19A, in Experimental Example 1, the light source 364A, which was turned on after the heat processing of the Y dye layer 406, was continued to be lit until the entire processing was completed. The light source 364B, which was turned on after the heat processing of the M dye layer 404, was continued to be lit until the entire processing was completed.

According to the results of this experiment, although fixation took place sufficiently, the M dye layer 404 was fixed, though slightly, owing to the wavelength in the vicinity of 365 nm included in the light from the light source 364A, and a decline in the density occurred.

Experimental Example 2

As shown in FIG. 19B, in Experimental Example 2, the light source 364A, which was turned on after the heat processing of the Y dye layer 406, was temporarily turned off after the completion of the fixation processing of unnecessary color-development components. Then, the light source 364A was turned on again together with the light source 364B which was turned on after the heat processing of the M dye layer 404, and was continued to be lit until the overall processing was completed.

According to the results of this experiment, the effect on the M dye layer 40A could be reduced by the turning on of the light source 364A, and fixation took place sufficiently.

Experimental Example 3

As shown in FIG. 19C, in Experimental Example 3, after the heat processing of the Y dye layer 406 and the heat processing of the M dye layer 404, both the light sources 364A and 364B were turned on for a duration corresponding to the duration required for the fixation processing of the unnecessary color-development components to be completed. After the heat processing of the C dye layer 408, only the light source 364B was turned on again.

According to the results of this experiment, the coloration of the texture was practically unobserved, and the uncoloration process can be omitted with respect to the Y dye layer 406. Hence, the recording period can be shortened.

Figure 20:
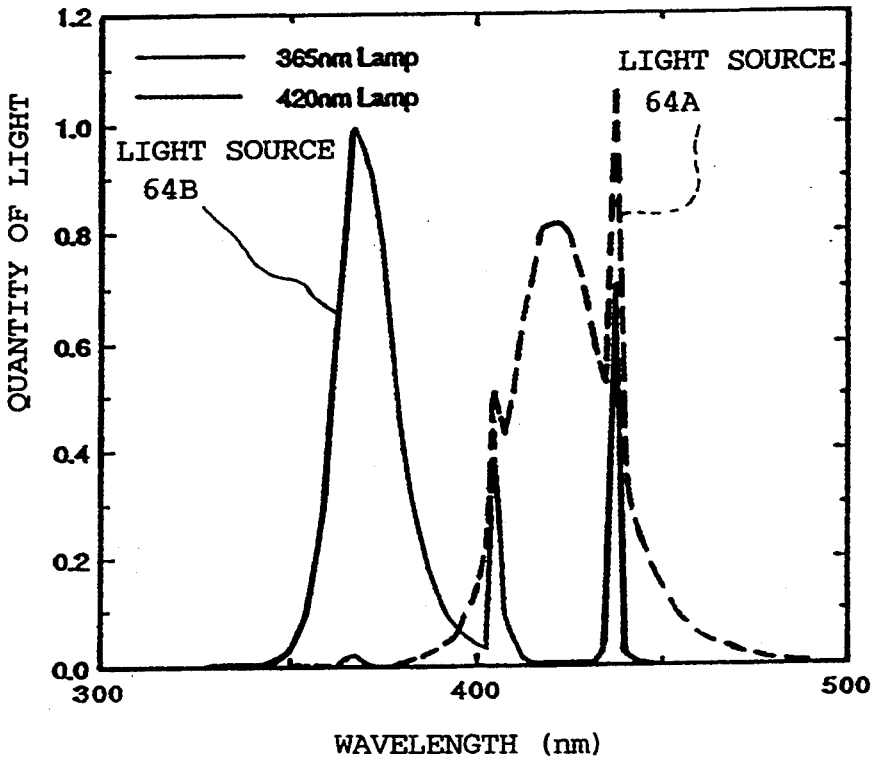
FIG. 20 is a wavelength/light amount characteristic diagram of each light source.

It should be noted that, as is apparent from the experimental results of Experimental Example 1, even if the wavelength of the light of the light source 364A is set to 420 nm, the light of the 365 nm wavelength is included due to its flare, as shown in FIG. 20. Therefore, the continued lighting of the light source 364A during the heat processing of the M dye layer 404 affects the color development of the M dye layer 404, in addition, the light source 364B similarly outputs wavelengths other than the necessary wavelength of 365 nm.

To overcome this problem, it suffices if the light from each of the light sources 364A and 364B is applied to the thermal recording material 310 via a filter. As a filter to be disposed in the light source 364A, the Type SC41 made by Fuji Photo Film Co., Ltd. is applicable. This filter cuts off wavelengths below 410 nm.

In addition, the filter to be disposed in the light source 364B can be arranged by combining interference filters.

It should be noted that although, in this embodiment, the uncoloration process was performed by continuing the lighting of the light sources 364A and 364B, the uncoloration process may be effected by providing a light source separately.

Furthermore, in this embodiment, the thermal recording material 310 is wound around the support drum 330 and is made to undergo three revolutions to effect heat processing and fixation processing with respect to the color-development layers, as described above. Alternatively, the apparatus may be so arranged that the thermal recording material 310 is transported rectilinearly while being nipped by a pair of transport rollers, and is made to undergo one and a half reciprocations along that transport passage, so as to effect heat processing and fixation processing.

As described above, the image recording method in accordance with the third embodiment offers an outstanding advantage in that the recording period can be shortened on the basis of the characteristics of durations necessary for the fixation of unnecessary color-development components and for uncoloration which are performed during fixation processing.

Fourth Embodiment

Next, a description will be given of a fourth embodiment.

Figure 21:
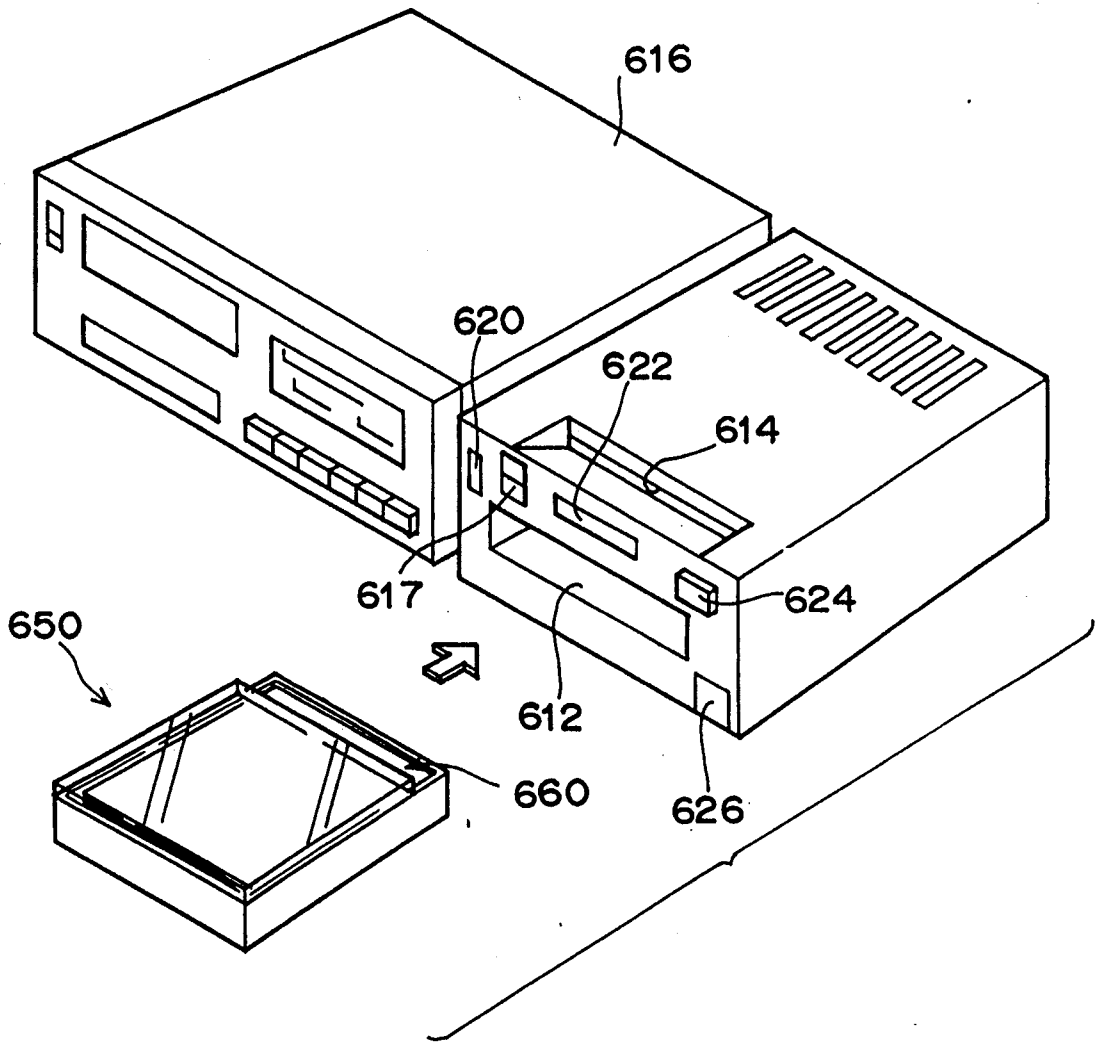
FIG. 21 is a perspective view illustrating the outer appearance of an image recording apparatus in accordance with a fourth embodiment.

FIG. 21 schematically illustrates the structure of an image recording apparatus in accordance with the fourth embodiment.

A slit-like insertion port 612, which is used for a cassette 650 with a thermal recording material 510 accommodated therein, and a discharge port 614, through which the thermal recording material 510 for which processing has been completed is discharged, are provided at upper and lower positions in a front surface of the image recording apparatus. Sheets of the thermal recording material 510 of the same size are accommodated in the cassette 650 in a superposed state, and are fed into the interior of the apparatus beginning with an uppermost sheet of the thermal recording material 510.

Figure 22:
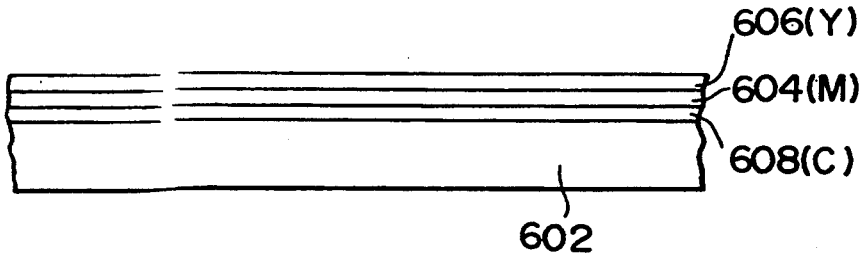
FIG. 22 is a cross-sectional view illustrating a multicolor thermal recording material used in the fourth embodiment.

As shown in FIG. 22, the thermal recording material 510 is arranged such that, a cyan dye layer (hereafter referred to as the C dye layer) 608, a magenta dye layer (hereafter referred to as the M dye layer) 604, and a yellow dye layer (hereafter referred to as the Y dye layer) 606 are, in that order beginning with a lowermost layer, superposed on one surface of a printing paper base 602 in which polyethylene is laminated on wood free paper. All of these layers are transparent. The Y dye layer 606 and the M dye layer 604 are of a photochemically fixing type, and are of such a nature that these layers, once respectively irradiated with light of a 420 nm wavelength and a 365 nm wavelength, do not change even on heating.

A so-called half-moon roller 664 is provided on the inner side of the insertion port 612. This half-moon roller 664 remains stationary in a state in which its notched portion 664A opposes the uppermost sheet of the thermal recording material 510 in the cassette 650, and a gap is produced in this state.

Here, if the half-moon roller 664 undergoes one revolution, its peripheral surface is brought into contact with the uppermost sheet of the thermal recording material 510, and only this uppermost sheet of the thermal recording material 510 is drawn out from the cassette 650 by means of a frictional force and can be transported to the inner side of the insertion port 612.

A pair of transport rollers 572 are disposed on the more recessed side of the insertion port 612. The thermal recording material 510 drawn out by the half-moon roller 664 is nipped by this pair of transport rollers 572 and is further transported.

A VTR 616, for example, is connected to the image recording apparatus, and image recording signals at the time of image recording by a thermal head 532 (see FIG. 23), which will be described later, are prepared on the basis of image signals from this VTR 616. As another image signal source that can be connected to the image recording apparatus, it is possible to cite a CCD camera or the like.

A power switch 620, a display unit 622 for displaying the number of prints and the like, and a print button 624 are provided on a front panel 617 provided with the aforementioned insertion port 612 and the discharge port 614. In addition, an openable sub-cover 624 is provided below the print button 624, and an unillustrated knob for fine adjustment of picture quality, and the like are attached behind the sub-cover 624.

Figure 23:
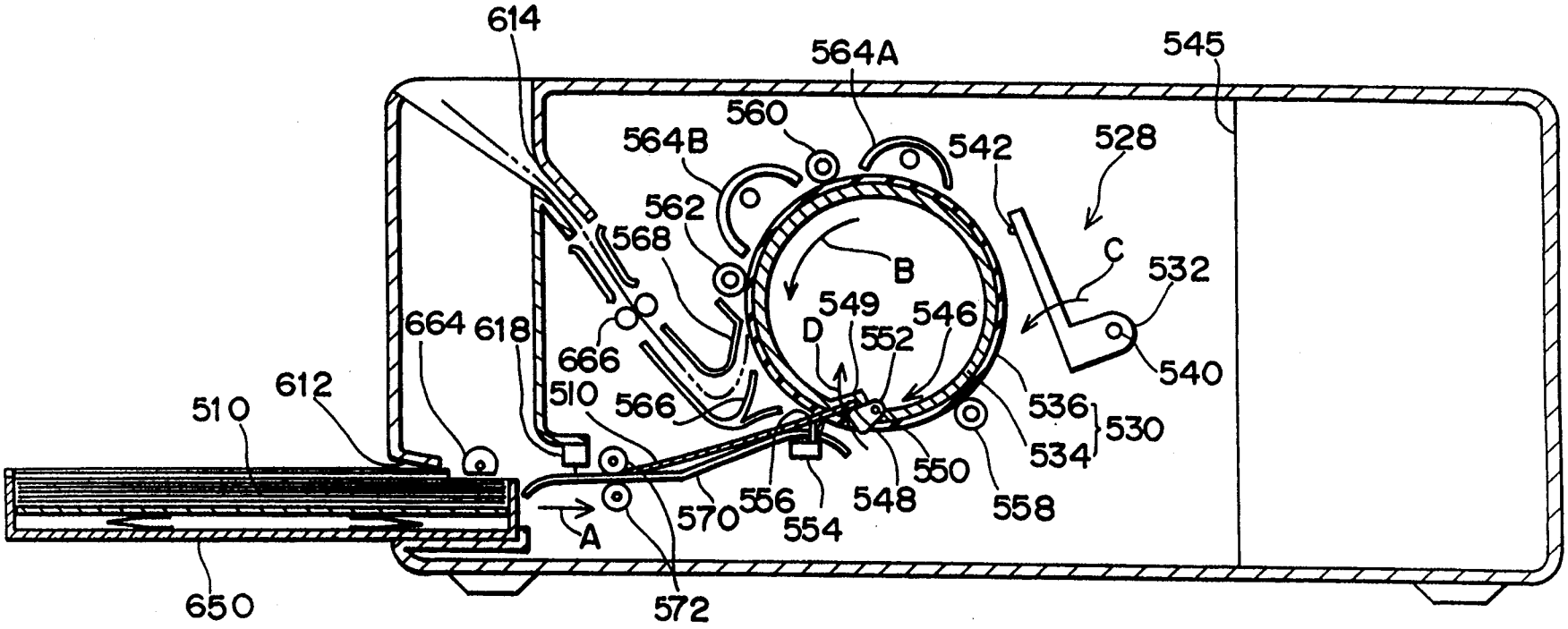
FIG. 23 is a cross-sectional view illustrating an internal arrangement of the image recording apparatus in accordance with the fourth embodiment.
Figure 24:
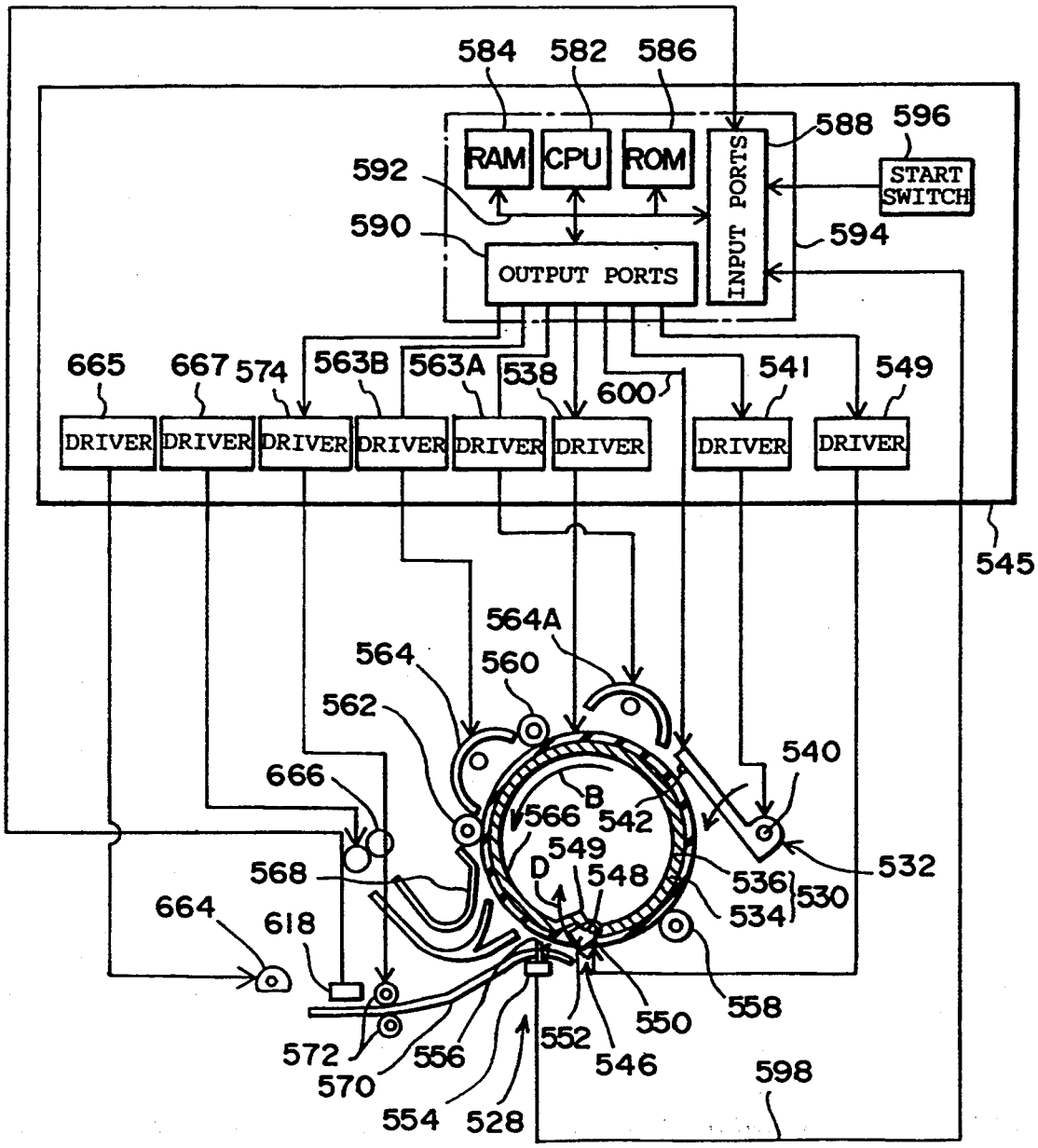
FIG. 24 is a control block diagram in accordance with the fourth embodiment.
Figure 25:
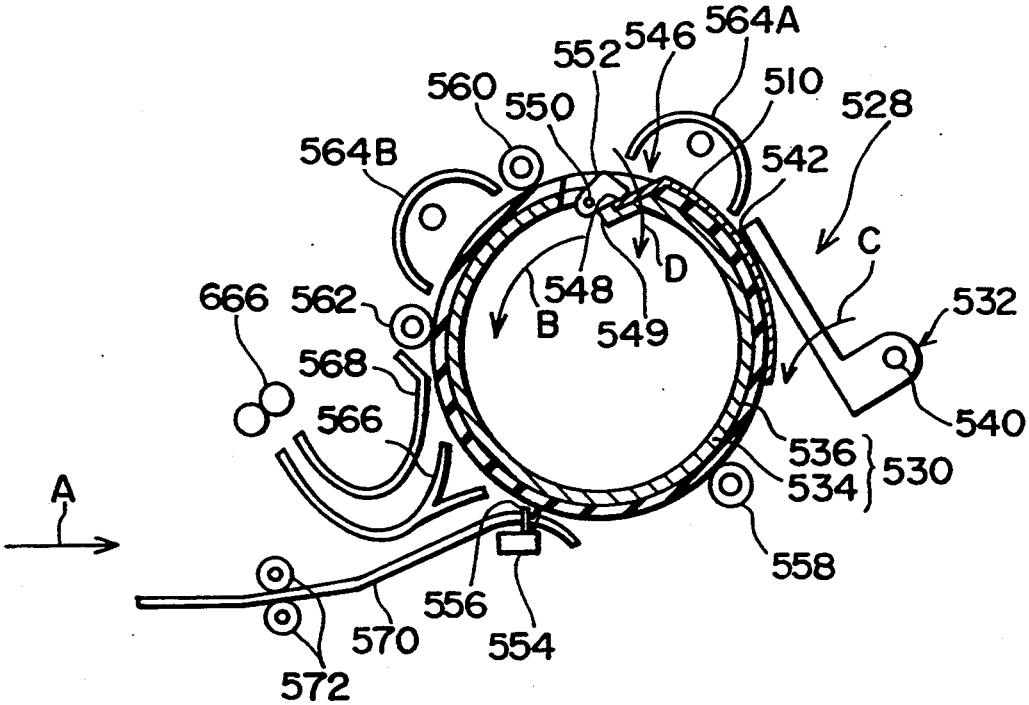
FIG. 25 is an enlarged view of a support drum and its vicinity in accordance with the fourth embodiment.

As shown in FIGS. 23 to 25, the thermal recording material 510 drawn out from the cassette 650 is detected by a limit switch 618. Subsequently, the thermal recording material 510 is nipped by the pair of transport rollers 572 driven by the driving force of a driver 574, is transported while being guided by a guide plate 570, and is guided to a heat processing section 528.

The heat processing section 528 is provided with a support drum 530, which is a rotating member, and a line-type thermal head 532, which is a recording head. The thermal recording material 510 is heated by the thermal head 532 in a state in which the thermal recording material 510 is wound around this support drum 530. The support drum 530 is formed of a metallic cylindrical member 534, and a resilient member 536 is wound around an outer periphery thereof. The support drum 530 is rotated at a constant velocity in the direction of arrow B in FIGS. 23 to 25 by the driving force of a driver 538. The support drum 530 serves to make the thermal recording material 510 wound around the support drum 530 to consecutively correspond to the thermal head 532.

One side of the thermal head 532 is pivotally supported on a frame of the apparatus via a shaft 540; and is rotated in the direction of arrow C in FIGS. 23 to 25 and in the opposite direction thereto about this shaft 540 by the driving force of a driver 541. Heating elements 542 disposed on the other side of the thermal head 532 are moved into contact with and away from the thermal recording material 510 wound around the support drum 530. Image signals are outputted to the heating elements 542 from a controller 545 when the heating elements 542 are brought into contact with the thermal recording material 510, so as to form an image on the thermal recording material 510 by heating in correspondence with image signals 600.

The thermal recording material 510 transported to the heat processing section 528 by transport rollers 526 is guided by the guide plate 570 along the transport passage, and reaches a recessed portion 548 constituting a part of a holding portion 546 provided around the outer periphery of the support drum 530. A latch pawl 552, which constitutes the holding portion together with the recessed portion 548, is pivotally supported in the recessed portion 548 via a shaft 550 disposed parallel with the rotating shaft of the support drum 530. This latch pawl 552 serves to hold one end of the thermal recording material 510 as the latch pawl 552 rotates in the direction of arrow D in FIGS. 23 to 25 via the shaft 550 by the driving force of a driver 549 when one end of the thermal recording material 510 guided by the guide plate 570 is accommodated in the recessed portion 548. The thermal recording material 510, when held by this latch pawl 552, is consecutively wound around the outer periphery of the support drum 530 as the support drum 530 rotates.

The timing at which the latch pawl 552 holds the thermal recording material 510 is provided by a limit switch 554 disposed midway in the transport passage of the thermal recording material 510. Namely, when the thermal recording material 510 reaches the position of this limit switch 554, an actuator 556 of the limit switch 554 interferes with the thermal recording material 510, and changes over a contact (in this embodiment, a normally open type is used as the limit switch 554, and is set to an on state when in contact with the thermal recording material 510). On (high level) and off (low level) signals from the limit switch 554 are supplied to the controller 545. The controller 545 is adapted to effect the operation (rotation in the direction of arrow D in FIG. 23) of the latch pawl 552 after the lapse of a predetermined time (at least after the leading end of the thermal recording material 510 has reached an innermost portion of the recessed portion 548) set in correspondence with the traveling speed of the thermal recording material 510. As a result, in a state in which the thermal recording material 510 is held by the latch pawl 552, the position of the thermal recording material 510 relative to the support drum 530 is constantly fixed, with the result that positioning is effected accurately.

Idle rollers 558, 560, and 562 are disposed at the outer periphery of the support drum 530 at a plurality of locations (three in this embodiment). The thermal recording material 510 is wound closely around the outer periphery of the support drum 530 by means of the support drum 530 and these idle rollers 558, 550, and 562. In addition, light sources 564A and 564B, which are electrically connected to the controller 545 via drivers 563A and 563B, are disposed on the downward side of the support drum 530 as viewed in the rotating direction thereof at a position for heating the thermal recording material 510 by the thermal head 532. These light sources 564A and 564B are adapted to emit light to the thermal recording material 510. The wavelengths of the light from these light sources 564A and 564B are set to be 420 nm and 365 nm, respectively. The light source 564A is used for fixing the Y dye layer 606 of the thermal recording material 510, while the light source 564B is used for fixing the M dye layer 604. Namely, in this embodiment, the support drum 530 is adapted to undergo three revolutions continuously after starting the rotation. During the first revolution of the thermal recording material 510, the heat processing of the Y dye layer 606 is effected by the thermal head 532, and fixing is carried out immediately after this processing.

During the next revolution of the support drum 530, i.e., during the second revolution, the M dye layer 604 (see FIG. 22) disposed below the Y dye layer 606 is subjected to heat processing and is fixed, and during the third revolution the C dye layer 608 is subjected to heat processing.

It should be noted that the energy (quantity of heat) which the thermal recording material 510 receives from the heating elements 542 is controlled by the controller 545 such that the energy is set to a weak level during the first revolution of the support drum 530, during which the M dye layer 604 and the C dye layer 608 in the lower layers remain unaffected. During the second revolution, the energy is set to a medium level, and during the third revolution, the energy is set to a strong level.

The thermal recording material which has undergone heat processing and on which the image has been formed is nipped by a pair of transport rollers 666 and are guided and discharged to the discharge port 614.

The controller 545 is provided with a microcomputer 594 comprising a CPU 582, a RAM 584, a ROM 586, input ports 588, and output ports 590, and buses 592 including a data bus connecting them and a control bus. Electrically connected to the input ports 588 are the print button 624 and the limit switch 618. A series of heat processing is conducted through the operation of this print button 624 and the detection of the thermal recording material 510 by the limit switch 618. In addition, a signal line 598 from the aforementioned limit switch 554 is also electrically connected to the input ports 588.

The support drum 530, the thermal head 532, the latch pawl 552, the light sources 564A and 564B, the transport rollers 572, the half-moon roller 664, and the transport rollers 666 are electrically connected to the output ports 590 via the drivers 538, 541, 549, 563A, 563B, 574, 665, and 667, respectively, and the driving of each of these components is controlled. In addition, the signal line 600 for supplying the image signals to the thermal head 532 is also electrically connected to the output ports 590.

Figure 26:
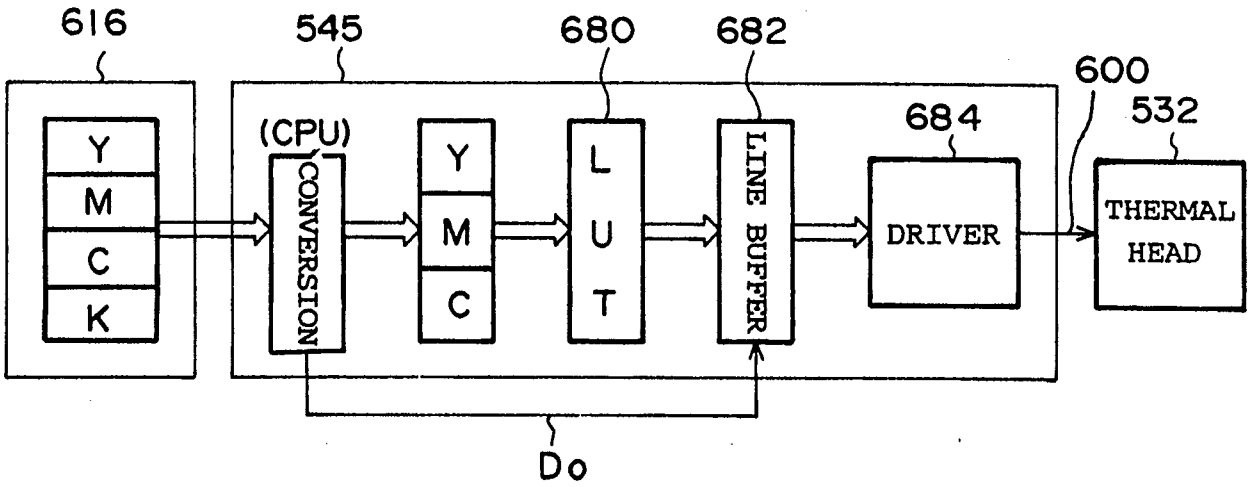
FIG. 26 is a block diagram illustrating the flow of an image signal in a controller of the fourth embodiment.

FIG. 26 is a block diagram illustrating the flow for heating the heating elements 542 of the thermal head 532 on the basis of the image signals.

The YMC signals representing the respective colors of Y, M, and C, as well as the K (black) signal representing characters and the like, are included in the image signals from the VTR 616. These signals are converted to the three colors of Y, M, and C by the controller 545.

The image signals of the respective colors thus converted are expressed by gradations (0–255 in the case of 256 gradations) which indicate densities. These image signals are outputted to a line buffer 682 for storing a one-line portion of data via a lookup table (LUT) 680. A pulse signal from the driver 538 for rotating the support drum 530 is inputted to the line buffer 682, and the one-line portion of the signal is outputted to the driver 684 in synchronism with the rotation of the support drum 530. As a result, the heating elements 542 of the thermal head 532 generate heat, and impart the energy (quantity of heat) to the respective color-development layers.

Here, in this embodiment, a pixel whose indicated density based on the image signal becomes 0 is sorted during the conversion by the CPU 582. Then, a signal (signal line $D_0$ in FIG. 26) corresponding to predetermined energy (a maximum value of energy for heat-processing the M dye layer 604) is outputted to a table on the line buffer 682 which corresponds to the pixel whose indicated density based on that image signal becomes 0, during the heat processing of the third layer (C dye layer 608).

As a result, maximum energy for heat-processing the M dye layer 604 is imparted to the pixel whose indicated density based on the image signal becomes 0, during the heat processing of the C dye layer 608. Hence, energy exceeding a predetermined level is imparted to all the pixels.

It is known that a difference in the luster of finished images is produced in the image to which more than a predetermined level of energy was imparted and in the image to which it was not. The above-described processing in this embodiment serves to overcome the nonuniformity in luster.

The operation of this embodiment will be described hereafter.

When the print button 624 is operated, the half-moon roller 664 undergoes one revolution. As a result, the uppermost sheet of the thermal recording material 510 is brought into contact with the peripheral surface of the half-moon roller 664, and is drawn out by means of a frictional force.

The thermal recording material 510 drawn out by the half-moon roller 664 moves while being guided by the guide plate 570. When the limit switch 618 is turned on, the transport rollers 572 start driving and the thermal recording material 510 is transported by a predetermined amount.

When the thermal recording material 510 is further transported, the thermal recording material 510 is brought into contact with the actuator 556 of the limit switch 554. Here, when the limit switch 554 is turned on, a high-level signal is inputted to the input ports 588, and after the lapse of a predetermined time the latch pawl 552 is rotated in the direction of arrow D. During this predetermined time, the leading end portion of the thermal recording material 510 is accommodated in the recessed portion 584 of the support drum 530, and the leading end thereof abuts against the retaining portion 549, and the leading end portion thereof is held by the latch pawl 552.

When the leading, end portion of the thermal recording material 510 is held by the latch pawl 552, the support drum 530 starts to rotate in the direction of arrow B (first revolution). The first heat processing control is effected at this time. That is, when the holding portion 546 passes by the heating elements 542 of the thermal head 532, a driving signal is outputted from the output ports 590 via the driver 541, whereupon the thermal head 532 is rotated in the direction of arrow C about the shaft 540, causing the heating elements 542 to be brought into contact with the thermal recording material 510. Consequently, the support drum 530 is rotated in a state in which the heating elements 542 abut against the thermal recording material 510, and image signals are outputted to the heating elements 542 in conjunction with that rotation.

The quantity of heat of the heating elements 542 is set to the weak level, the thermal recording material 510 is heated in response to the image signals, and only the Y dye layer 606 is made to develop its color. Upon completion of the heat processing by the heating elements 542, the thermal head 532 is rotated in the opposite direction to the direction of arrow C about the shaft 540, causing the heating elements 542 to move away from the thermal recording material 510.

Then, the light of the 420 nm wavelength is radiated thermal recording material 510. As a result, the Y dye layer 606 is fixed. Next, the operation proceeds to the second revolution without a pause, and the heat processing of the M dye layer 604 is effected. Namely, the quantity of heat for heat processing by the heating elements 542 is changed over to the medium level, and processing similar to the heating of the Y dye layer 606 is carried out. Thus, the thermal recording material 510 is heated in response to the image signals, causing only the M dye layer 604 to develop its color.

As for the thermal recording material 510 for which the heat processing of the M dye layer has been completed, the light of the 365 nm wavelength is radiated thereto by the light source 564B, thereby fixing the M dye layer 604.

Subsequently, the operation proceeds to the third revolution to effect the heat processing of the C dye layer 608. That is, the quantity of heat for heat processing by the heating elements 542 is changed over to the strong level, and the thermal recording material 510 is heated in response to the image signals, causing only the C dye layer 608 to develop its color.

During this heat processing of the C dye layer 608, a maximum value (corresponding to the medium level) of energy for heat-processing the M dye layer 604 is inputted to the table corresponding to the image whose indicated density based on the image signal is 0. Therefore, the predetermined energy is imparted to the pixel whose indicated density based on the image signal is 0, simultaneously with the heat processing of the C dye layer 608.

Upon completion of the heat processing of the respective color-development layers, the heating elements 542 of the thermal head 532 are moved away from the thermal recording material 510, and after the lapse of a predetermined time, the holding portion 564 passes by the idle roller 562. At this point of time, the nipping of the thermal recording material 510 by the holding portion 546 is canceled, and the thermal recording material 510 is transported between guide plates 566 and 568 in conjunction with the rotation of the support drum 530.

The thermal recording material 510 placed between the guide plate 566 and 568 is nipped by the transport rollers 666. As the thermal recording material 510 is transported by a predetermined amount by the transport rollers 666, the thermal recording material 510 is fed out through the discharge port 614 and is discharged. This completes the heat processing of one sheet of the thermal recording material.

Thus, in this embodiment, more than a predetermined level of energy is imparted to all the pixels, so that the nonuniformity in the luster of the finished image can be overcome.

In particular, there has hitherto been a difference in the luster between white frame portions surrounding an image on the one hand, and the image on the other. This has produced unnaturalness. In this embodiment, however, since this difference is eliminated, it is possible to improve the reproducibility of an image based on the image signals.

When ten subjects were made to evaluate the difference in the luster, a result was obtained from all the subjects that no difference could be perceived in this embodiment, and that the difference was discernable in images not provided with the above-described processing.

In addition, in this embodiment, since more than a predetermined level of energy was imparted to the pixel whose indicated density based on the image signal becomes 0, simultaneously with the heat processing of the C dye layer 608, it is possible to impart sufficient energy. However, this energy may be imparted simultaneously with the heat processing of the M dye layer 604. In this case, the energy to be imparted is restricted to the maximum value of energy for causing the Y dye layer 606 to develop its color. However, substantially no effect is produced in so doing, and it is possible to obtain an appropriate image which is free from the difference in luster.

Furthermore, in this embodiment, although, during scan recording, a predetermined level of energy is imparted only to the pixel whose indicated density based on the image signal is 0, an arrangement may be alternatively provided such that the transport rollers 666 for discharging the thermal recording material 510 are formed as heat rollers so as to impart the predetermined level of energy to the overall surface of the thermal recording material 510.

As described above, the image recording method in accordance with the fourth embodiment offers outstanding advantages in that the luster of the finished image can be made uniform and the reproducibility based on the image signals can be improved without extending the overall recording period.

What is claimed is:

1. A method for recording an image on a thermal recording material in which a plurality of color-development layers are laminated, said plurality of color-development layers being adapted to develop different colors, respectively, upon supply of thermal energy thereto and to form a substantially black color when all of said plurality of color-development layers undergo color development with a substantially identical density, comprising the steps of:

(a) preparing said thermal recording material in which said plurality of color-development layers are laminated; and (b) effecting recording such that, with respect to a portion where a color other than black is to be developed, a color-development density of each of said plurality of color-development layers becomes lower than a maximum color-development density of said each of said plurality of color-development layers, and effecting recording such that, with respect to a portion where black is to be developed, the color-development density of said each of said plurality of color-development layers becomes higher than a maximum value of color-development density of a portion surrounding the portion where black is to be developed.

2. A method of recording an image according to claim 1, wherein in step (b) said recording is effected by supplying to each of said plurality of color-development layers thermal energy corresponding to said each of said plurality of color-development layers.

3. A method of recording an image according to claim 1, wherein said recording in step (b) includes the steps of:

(c) applying light of a wavelength region corresponding to each of said plurality of color-development layers to form a latent image; and (d) heating the thermal recording material.

4. A method of recording an image according to claim 1, wherein said plurality of color-development layers are constituted by three color-development layers adapted to develop mutually different colors.

5. A method of recording an image according to claim 1, wherein in said recording in step (b) the color development of said plurality of color-development layers is effected consecutively beginning with an uppermost one of said color-development layers.

6. A method of recording an image according to claim 2, wherein the color development of said plurality of color-development layers is effected consecutively beginning with a color-development layer for which thermal energy for causing color development is the lowest among said plurality of color-development layers.

7. A method of recording an image according to claim 1, further comprising the step of:

(e) fixing the color of the color-development layer which undergoes color development earlier of two color-development layers which are made to undergo color development consecutively among said plurality of color-development layers.

8. A method of recording an image according to claim 7, wherein in said fixing step (e) the fixing of only unnecessary color-development components is completed.

9. A method for recording an image on a thermal recording material in which a plurality of color-development layers are laminated, said plurality of color-development layers being adapted to develop different colors, respectively, upon supply of thermal energy thereto and to form a substantially black color when all of said plurality of color-development layers undergo color development with a substantially identical density, comprising the steps of:

(a) preparing said thermal recording material in which said plurality of color-development layers are laminated; and (b) with respect to a portion where an image other than a character is to be recorded, recording said image other than said character such that a color-development density of each of said plurality of color-development layers becomes lower than a maximum color-development density of said each of said plurality of color-development layers, and with respect to a portion where a character image is to be recorded by causing at least one of said plurality of color-development layers to undergo color development, recording said character image such that the color-development density of said each of said plurality of color-development layers becomes higher than a maximum value of color-development density of a portion surrounding the portion where said character image is to be recorded.

10. A method of recording an image according to claim 9, wherein in step (b) said recording is effected by supplying to each of said plurality of color-development layers thermal energy corresponding to said each of said plurality of color-development layers.

11. A method of recording an image according to claim 9, wherein said recording in step (b) includes the steps of:

(c) applying light of a wavelength region corresponding to each of said plurality of color-development layers to form a latent image; and (d) heating the thermal recording material.

12. A method of recording an image according to claim 9, wherein said plurality of color-development layers are constituted by three color-development layers adapted to develop mutually different colors.

13. A method of recording an image according to claim 9, wherein in said recording in step (b) the color development of said plurality of color-development layers is effected consecutively beginning with an uppermost one of said color-development layers.

14. A method of recording an image according to claim 10, wherein the color development of said plurality of color-development layers is effected consecutively beginning with a color-development layer for which thermal energy for causing color development is the lowest among said plurality of color-development layers.

15. A method of recording an image according to claim 9, further comprising the step of:

(e) fixing the color of the color-development layer which undergoes color development earlier of two color-development layers which are made to undergo color development consecutively among said plurality of color-development layers.

16. A method of recording an image according to claim 15, wherein in said fixing step (e) the fixing of only unnecessary color-development components is completed.

17. A method of recording an image onto a thermal recording material in which a plurality of thermosensitive color-development layers are laminated, said plurality of thermosensitive color-development layers having mutually different sensitivities and being adapted to develop mutually different hues of color, comprising the steps of:

(a) causing a recording head to effect the scan recording of each of said plurality of thermosensitive color-development layers;

(b) fixing said each of said plurality of thermosensitive color-development layers scan recorded by application of light thereto; and (c) repeating steps (a) and (b) to record an image onto said thermal recording material, wherein the application to said thermal recording material of light capable of fixing a color to be developed by an nth scan recording (n is an integer) is continued after the starting of an (n+1)th scan recording.

18. A method of recording an image according to claim 17, wherein step (b) is performed during a period when the fixing of unnecessary color-development components of said each of said plurality of thermosensitive color-development layers is completed.

19. A method of recording an image according to claim 17, wherein said application is continued at least until the fixing of unnecessary uncolored components of said each of said plurality of thermosensitive color-development layers is completed.

20. A method of recording an image onto a thermal recording material in which a plurality of thermosensitive color-development layers are laminated by imparting energy thereto in correspondence with a predetermined density value set on the basis of a level of an image signal, said plurality of thermosensitive color-development layers having mutually different sensitivities and being adapted to develop mutually different hues of color, comprising the steps of:

(a) causing a recording head to effect the scan recording of each of said plurality of thermosensitive color-development layers;

(b) fixing said each of said plurality of thermosensitive color-development layers scan recorded by application of light thereto; and (c) repeating steps (a) and (b) to record an image onto said thermal recording material, wherein maximum energy of the energy imparted to the color-development layer for which the scan recording has already been completed is imparted to a portion where an indicated density at least based on said image signal is 0.

21. A method of recording an image onto a thermal recording material in which a plurality of thermosensitive color-development layers are laminated by imparting energy thereto in correspondence with a predetermined density value set on the basis of a level of an image signal, said plurality of thermosensitive color-development layers having mutually different sensitivities and being adapted to develop mutually different hues of color, comprising the steps of:

(a) causing a recording head to effect the scan recording of each of said plurality of thermosensitive color-development layers;

(b) fixing said each of said plurality of thermosensitive color-development layers scan recorded by application of light thereto; and (c) repeating steps (a) and (b) to record an image onto said thermal recording material, wherein maximum energy for an (n 1)th scan recording (n is an integer) is imparted to a portion where an indicated density based on said image signal is 0, during an nth scan recording.

22. A method of recording an image according to claim 21, wherein said nth scan recording is the scan recording of a final layer.

23. An image recording apparatus comprising:

a heat source for supplying thermal energy to a thermal recording layer in which a plurality of color-development layers adapted to develop different colors in correspondence with an amount of energy supplied thereto are laminated; and control means for controlling said heat source such that, with respect to a portion Where a color other than black is to be developed, a color-development density of each of said plurality of color-development layers becomes lower than a maximum color-development density of said each of said plurality of color-development layers, and for controlling said heat source such that, with respect to a portion where black is to be developed, the color-development density of said each of said plurality of color-development layers becomes higher than a maximum value of color-development density of a portion surrounding the portion where black is to be developed.

24. An image recording apparatus according to claim 23, further comprising: irradiating means for irradiating said plurality of color-development layers with light, wherein said control means controls the irradiation such that, to ensure that a portion of said each of said plurality of color-development layers which has not undergone color development will not undergo color development after said each of said plurality of color-development layers has undergone color development, the light of a wavelength corresponding to said each of said plurality of color-development layers is radiated.

25. An image recording apparatus according to claim 23, wherein said control means controls said heat source such that said plurality of color-development layers are consecutively made to undergo color development in an order starting with a color-development layer which undergoes color development with a smallest amount of thermal energy.

26. An image recording apparatus comprising:

a heat source for supplying thermal energy to a thermal recording layer in which a plurality of color-development layers adapted to develop different colors in correspondence with an amount of energy supplied thereto are laminated; and control means for controlling said heat source such that, with respect to a portion where an image other than a character is to be recorded, a color-development density of each of said plurality of color-development layers becomes lower than a maximum color-development density of said each of said plurality of color-development layers, and for controlling said heat source such that, with respect to a portion where a character image is to be recorded by causing at least one of said plurality of color-development layers to undergo color development, the color-development density of said each of said plurality of color-development layers becomes higher than a maximum value of color-development density of a portion surrounding the portion where said character image is to be recorded.

27. An image recording apparatus according to claim 26, further comprising: irradiating means for irradiating said plurality of color-development layers with light, wherein said control means controls the irradiation such that, to ensure that a portion of said each of said plurality of color-development layers which has not undergone color development will not undergo color development after said each of said plurality of color-development layers has undergone color development, the light of a wavelength corresponding to said each of said plurality of color-development layers is radiated.

28. An image recording apparatus according to claim 26, wherein said control means controls said heat source such that said plurality of color-development layers are consecutively made to undergo color development in an order starting with a color-development layer which undergoes color development with a smallest amount of thermal energy.

29. An image recording apparatus comprising:

irradiating means for applying light to a thermal recording layer having a plurality of layers whose color development is suppressed as the light of different ultraviolet wavelength regions is applied to said plurality of layers, so as to expose said thermal recording material;

control means for controlling an exposure by said irradiating means such that, with respect to a portion where a color other than black is to be developed, a color-development density of each of said plurality of color-development layers becomes lower than a maximum color-development density of said each of said plurality of color-development layers, and for controlling the exposure by said irradiating means such that, with respect to a portion where black is to be developed, the color-development density of said each of said plurality of color-development layers becomes higher than a maximum value of color-development density of a portion surrounding the portion where black is to be developed; and a heat source for heating said thermal recording material exposed, so as to effect heat development of said thermal recording material.

30. An image recording apparatus comprising:

irradiating means for applying light to a thermal recording layer having a plurality of layers whose color development is suppressed as the light of different ultraviolet wavelength regions is applied to said plurality of layers, so as to expose said thermal recording material;

control means for controlling an exposure by said irradiating means such that, with respect to a portion where an image other than a character is to be recorded, a color-development density of each of said plurality of color-development layers becomes lower than a maximum color-development density of said each of said plurality of color-development layers, and for controlling the exposure by said irradiating means such that, with respect to a portion where a character image is to be recorded by causing at least one of said plurality of color-development layers to undergo color development, the color-development density of said each of said plurality of color-development layers becomes higher than a maximum value of color-development density of a portion surrounding the portion where said character image is to be recorded; and a heat source for heating said thermal recording material exposed, so as to effect heat development of said thermal recording material.

* * * * *